US010774502B2

(12) United States Patent
Sakai et al.

(10) Patent No.: US 10,774,502 B2
(45) Date of Patent: Sep. 15, 2020

(54) WORK MACHINE

(71) Applicant: HITACHI CONSTRUCTION MACHINERY CO., LTD., Tokyo (JP)

(72) Inventors: Daito Sakai, Tsuchiura (JP); Shiho Izumi, Hitachinaka (JP); Ryuu Narikawa, Mito (JP); Kouji Ishikawa, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 188 days.

(21) Appl. No.: 16/083,104

(22) PCT Filed: Feb. 28, 2017

(86) PCT No.: PCT/JP2017/007988
§ 371 (c)(1),
(2) Date: Sep. 7, 2018

(87) PCT Pub. No.: WO2018/008188
PCT Pub. Date: Jan. 11, 2018

(65) Prior Publication Data

US 2019/0127946 A1 May 2, 2019

(30) Foreign Application Priority Data

Jul. 6, 2016 (JP) ..... 2016-134387

(51) Int. Cl.
*E02F 3/43* (2006.01)
*E02F 9/20* (2006.01)
(Continued)

(52) U.S. Cl.
CPC ..... *E02F 3/435* (2013.01); *E02F 3/32* (2013.01); *E02F 3/43* (2013.01); *E02F 9/20* (2013.01);
(Continued)

(58) Field of Classification Search
CPC ..... E02F 3/435; E02F 9/20; E02F 3/43; E02F 3/32; E02F 9/2004; E02F 9/2033;
(Continued)

(56) References Cited

U.S. PATENT DOCUMENTS 4,103,791 A * 8/1978 Ullmann ..... E02F 3/306 414/708
4,143,778 A * 3/1979 Ullmann ..... E02F 3/306 414/694
(Continued)

FOREIGN PATENT DOCUMENTS

JP 2013-217138 A 10/2013
JP 5706050 B1 4/2015
(Continued)

OTHER PUBLICATIONS

International Search Report of PCT/JP2017/007988 dated May 16, 2018.
(Continued)

*Primary Examiner* — Frederick M Brushaber
(74) *Attorney, Agent, or Firm* — Mattingly & Malur, PC

(57) ABSTRACT

A work machine includes: a multi-joint type work implement; a plurality of hydraulic actuators driving the work implement; an operation device outputting an operation signal to the plurality of hydraulic actuators; a storage section storing a target configuration defined by connecting a plurality of target surfaces; a control object surface selection section that in the case where a control point set at a claw tip of a bucket is under the target configuration, uses a target surface closest to the control point on the target configuration as a control object surface; and a target operation control section that controls the plurality of hydraulic actuators such that the operational range of the control point is limited to the control object surface and a region above the
(Continued)

same in the case where an excavation operation is input from an operator via the operation device.

4 Claims, 16 Drawing Sheets

(51) Int. Cl.
*E02F 3/32* (2006.01)
*E02F 9/22* (2006.01)
*E02F 9/26* (2006.01)

(52) U.S. Cl.
CPC ..... *E02F 9/2004* (2013.01); *E02F 9/2033* (2013.01); *E02F 9/2203* (2013.01); *E02F 9/2271* (2013.01)

(58) Field of Classification Search
CPC ..... E02F 9/2203; E02F 9/2271; E02F 9/265; E02F 9/262; E02F 9/2037
See application file for complete search history.

(56) References Cited

U.S. PATENT DOCUMENTS 5,975,833 A * 11/1999 Yamada ..... E02F 3/301 414/687
6,140,787 A * 10/2000 Lokhorst ..... E02F 3/435 318/568.18
2014/0200776 A1 7/2014 Matsuyama et al.
2016/0244950 A1 8/2016 Kami et al.
2017/0254047 A1* 9/2017 Kortesalmi ..... E02F 3/38
2017/0342678 A1* 11/2017 Iwamura ..... E02F 3/3677
2018/0355583 A1* 12/2018 Moriki ..... E02F 9/2025
2019/0127946 A1* 5/2019 Sakai ..... E02F 9/2203
2019/0177948 A1* 6/2019 Matsuyama ..... E02F 9/20
2019/0218749 A1* 7/2019 Hiromatsu ..... E02F 9/20
2019/0284783 A1* 9/2019 Moriki ..... E02F 3/32
2019/0338494 A1* 11/2019 Moriki ..... E02F 9/2242
2020/0141091 A1* 5/2020 Narikawa ..... E02F 9/2033

FOREIGN PATENT DOCUMENTS

WO 2014/192474 A1 12/2014
WO 2015/181989 A1 3/2015

OTHER PUBLICATIONS

International Preliminary Report on Patentability received in corresponding International Application No. PCT/JP2017/007988 dated Jan. 17, 2019.

* cited by examiner

| DETERMI-NATION RESULT IN S201 | DETERMI-NATION RESULT IN S206 | EXAMPLE |
|---|---|---|
| NO | — |  |
| YES | NO |  |
| YES | YES |  |

WORK MACHINE

TECHNICAL FIELD

The present invention relates to a work machine.

BACKGROUND ART

In a hydraulic excavator included in a work machine, in the case where an excavation operation (for example, arm crowding operation) is input from the operator via an operation lever, a boom raising operation is forcibly added by a computer (controller) in accordance with the distance between the forward end of a front work implement and a previously set target surface, whereby the operational range of the front work implement is limited to the target surface or a region above the same. This control is sometimes referred to as an area limiting control, operation limiting control, or machine control.

To prevent an abrupt operation in boom raising due to the area limiting control (operation limiting control) in the case where the target surface (design surface) is inclined with respect to the horizontal direction by a predetermined angle or more, Patent Document 1, for example, discloses a technique in which in the case where the target surface (design surface) is a slope inclined with respect to the horizontal direction by a predetermined angle or more, an operation limiting section performs control such that an area limiting control (operation limiting control) is not executed, whereby it is possible to prevent an abrupt operation of the boom in the case where the target surface (design surface) is a steep slope.

PRIOR ART DOCUMENTS

Patent Documents

Patent Document 1: Japanese Patent No. 5706050

SUMMARY OF THE INVENTION

Problem to be Solved by the Invention

A target configuration (design configuration) is sometimes defined by connecting a plurality of target surfaces (segments). In this case, it is necessary to select the optimum one as the control object (control object surface) from among the plurality of target surfaces with the progress of the excavation work and to execute an area limiting control. When the area limiting control is executed in a state in which the wrong target surface is selected as the control object, there is executed an area limiting control different from the one expected, so that there is a fear of the operator experiencing discomfort or of the claw tip of the bucket intruding under the right target surface.

In the work machine disclosed in Patent Document 1, no area limiting control is executed in the case where the target surface is inclined with respect to the horizontal surface by a predetermined angle or more. Thus, in the case where the target configuration is defined by connecting a target surface (first target surface) at an angle less than a predetermined angle and a target surface (second target surface) at an angle not less than the predetermined angle, when the first target surface and the second target surface are successively excavated in that order, the area limiting control is interrupted suddenly at the point in time when the control object is changed to the second target surface. Conversely, when the second target surface and the first target surface are excavated successively in that order, the area limiting control is suddenly allowed to be executed at the point in time when the control object is changed to the first target surface. In this way, in the case where a target configuration defined by a plurality of target surfaces of different inclination angles is continuously excavated, the area limiting control may or may not be executed. When the area limiting control is thus executed/interrupted suddenly, the operator experiences great discomfort, and the possibility of the claw tip of the bucket erroneously intruding under the target configuration becomes high.

It is an object of the present invention to provide a work machine capable of properly selecting a target surface constituting the control object of area limiting control in the case where a target configuration defined by a plurality of target surfaces of different inclination angles is excavated continuously.

Means for Solving the Problem

To achieve the above object, there is provided, in accordance with the present invention, a work machine including: a multi-joint type work implement; a plurality of hydraulic actuators driving the work implement; an operation device outputting an operation signal to the plurality of hydraulic actuators; a storage section storing a target configuration defined by connecting a plurality of target surfaces; a control object surface selection section that when a control point set at a forward end portion of the work implement is under the target configuration, uses a target surface closest to the control point on the target configuration as a control object surface; and a target operation control section that when an excavation operation is input from an operator via the operation device, controls the plurality of hydraulic actuators such that operational range of the control point is limited to the control object surface and a region above the control object surface.

Effect of the Invention

In accordance with the present invention, the target surface constituting the control object of the area limiting control is properly selected, so that the discomfort imparted to the operator is mitigated, and it is possible to prevent intrusion of the work implement under the target surface.

MODES FOR CARRYING OUT THE INVENTION

Figure 1:
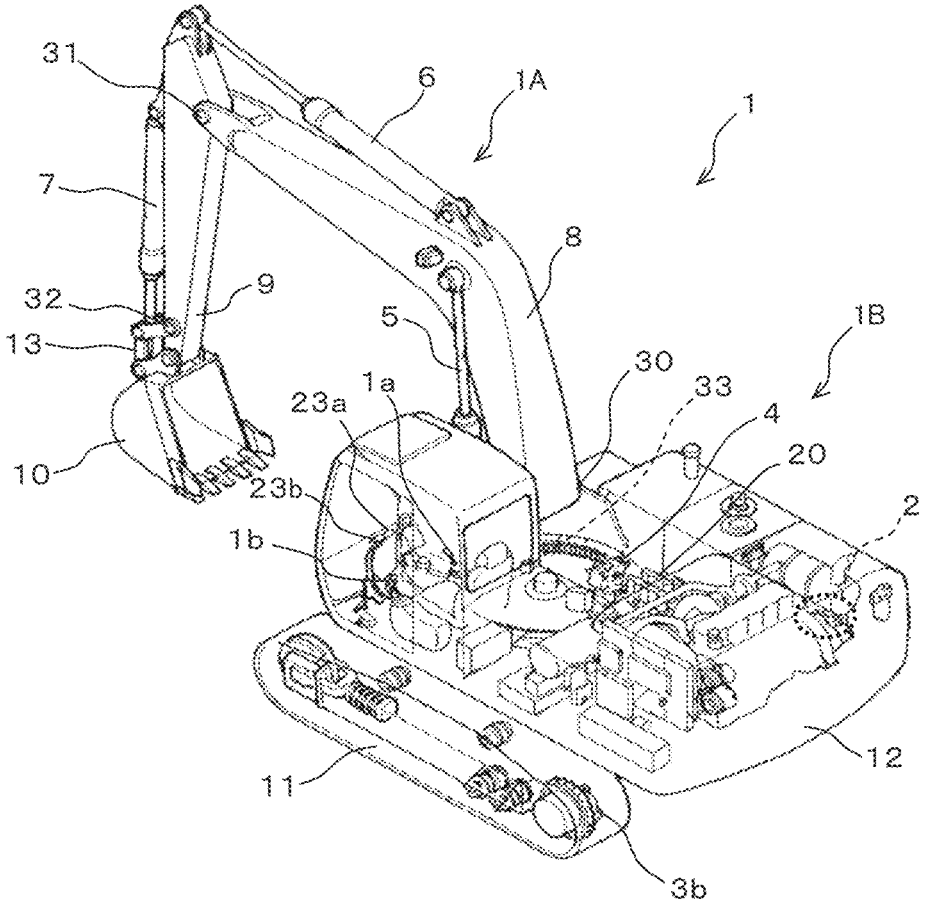
FIG. 1 is a diagram illustrating the structure of a hydraulic excavator.

In the following, embodiments of the present invention will be described with reference to the drawings. While in the following there is taken as an example a hydraulic excavator equipped with a bucket 10 as an attachment at the forward end of a work implement, the present invention may be applied to a hydraulic excavator equipped with an attachment other than a bucket. Further, the present invention is also applicable to a work machine other than a hydraulic excavator so long as it has a multi-joint type work implement which is formed by connecting a plurality of driven members (attachment, arm, boom, etc.) and which operates in a predetermined operational plane.

Further, in the present specification, the words "on," "above," and "under," which are used with the terms indicating certain configurations (for example, the target surface, target configuration, setback configuration, control object surface, etc.), are defined as follows. The word "on" means the "surface" of a certain configuration, the word "above" means "a position higher than the surface" of a certain configuration, and the word "under" means "a position lower than the surface" of a certain configuration. Further, in the following description, in the case where there exist a plurality of identical components, an alphabetical letter may be added to the reference numeral (number). In some cases, however, the alphabetical letter may be omitted, with the plurality of components being expressed collectively. For example, when there exist three pumps 300*a*, 300*b*, and 300*c*, these may be collectively expressed as the pumps 300.

First Embodiment

Figure 2:
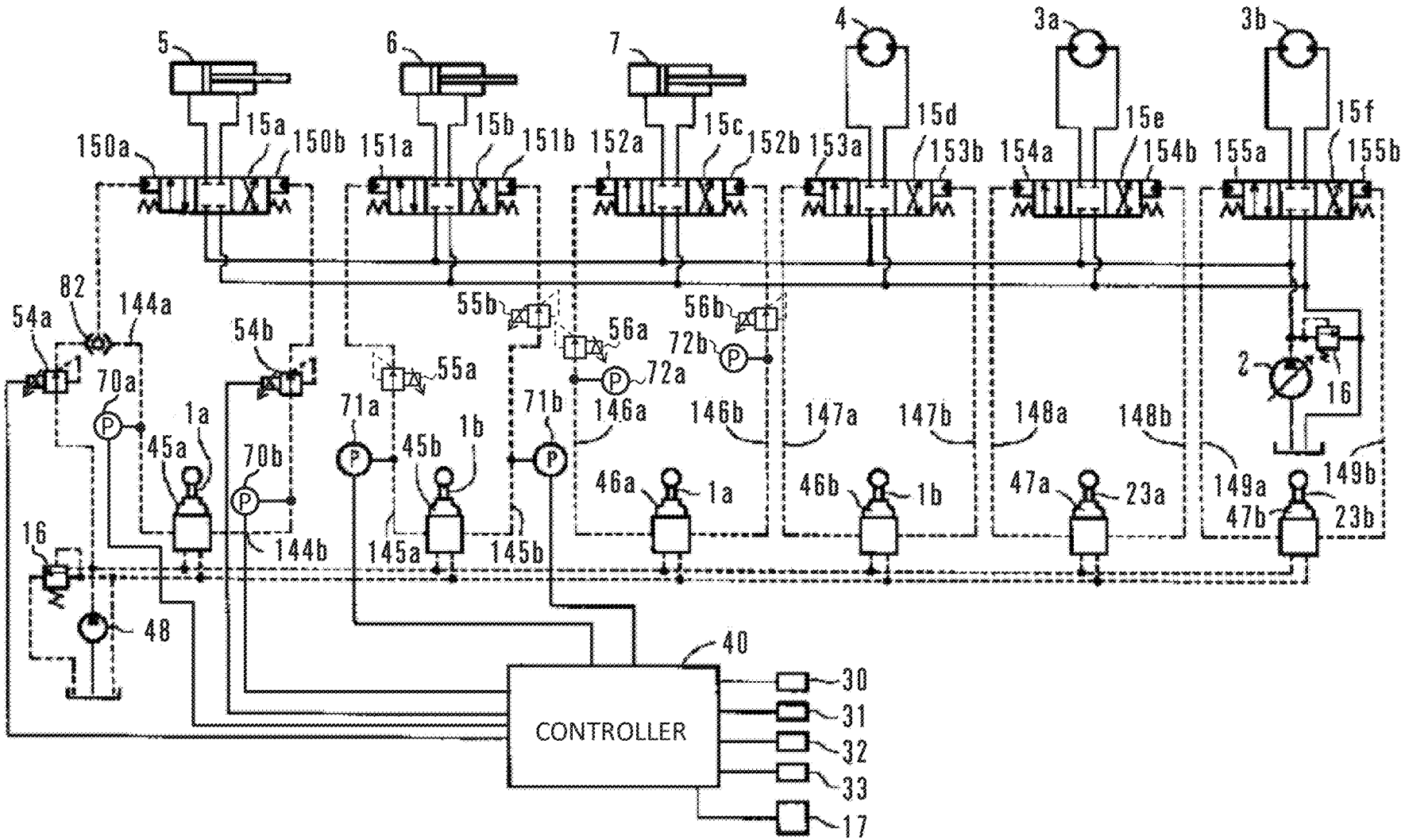
FIG. 2 is a diagram illustrating a controller of the hydraulic excavator along with a hydraulic drive system.

FIG. 1 is a diagram illustrating the structure of a hydraulic excavator, and FIG. 2 is a diagram illustrating a controller of the hydraulic excavator along with a hydraulic drive system. In FIG. 1, a hydraulic excavator 1 is composed of a front work implement 1A and a machine body 1B. The machine body 1B is composed of a lower track structure 11, and an upper swing structure 12 swingably mounted on top of the lower track structure 11. The front work implement 1A is formed by connecting a plurality of driven members (a boom 8, an arm 9, and a bucket 10) each rotating in the vertical direction, and the proximal end of the boom 8 of the front work implement 1A is supported by the front portion of the upper swing structure 12.

The boom 8, the arm 9, the bucket 10, the upper swing structure 12, and the lower track structure 11 constitute the driven members respectively driven by a boom cylinder 5, an arm cylinder 6, a bucket cylinder 7, a swing hydraulic motor 4, and left and right traveling motors 3*a* and 3*b*. Operational orders to these driven members 8, 9, 10, 12, and 11 are output in accordance with the operation by the operator of a traveling right lever 23*a*, a traveling left lever 23*b*, an operation right lever 1*a*, and an operation left lever 1*b* (these may be collectively referred to as the operation levers 1 and 23) mounted in the cab on the upper swing structure 12.

Installed in the cab are an operation device 47*a* (see FIG. 2) having the traveling right lever 23*a*, an operation device 47*b* (see FIG. 2) having the traveling left lever 23*b*, operation devices 45*a* and 46*a* having the operation right lever 1*a*, and operation devices 45*b* and 46*b* having the operation left lever 1*b*. The operation devices 45 through 47 are of the hydraulic pilot type, and respectively supply pilot pressures (hereinafter also referred to as the operation pressures) in accordance with the operation amount (for example, the lever stroke) and the operational direction of the operation levers 1 and 23 operated by the operator as control signals to hydraulic drive sections 150*a* through 155*b* of corresponding flow control valves 15*a* through 15*f* (see FIG. 2) via pilot lines 144*a* through 149*b* (see FIG. 2), driving these flow control valves 15*a* through 15*f*.

The hydraulic fluid delivered from a hydraulic pump 2 is supplied to a traveling right hydraulic motor 3*a*, a traveling left hydraulic motor 3*b*, a swing hydraulic motor 4, a boom cylinder 5, an arm cylinder 6, and a bucket cylinder 7 via the flow control valves 15*a*, 15*b*, 15*c*, 15*d*, 15*e*, and 15*f* (see FIG. 2) in a control valve unit 20. Due to the hydraulic fluid supplied, the boom cylinder 5, the arm cylinder 6, and the bucket cylinder 7 expand and contract, whereby the boom 8, the arm 9, and the bucket 10 respectively rotate, and the position and posture of the bucket 10 vary. Further, due to the hydraulic fluid supplied, the swing hydraulic motor 4 rotates, whereby the upper swing structure 12 swings with respect to the lower track structure 11. Further, due to the hydraulic fluid supplied, the traveling right hydraulic motor 3*a* and the traveling left hydraulic motor 3*b* rotate, whereby the lower track structure 11 travels.

On the other hand, in order that the rotational angles $\alpha$, $\beta$, and $\gamma$ (see FIG. 4) of the boom 8, the arm 9, and the bucket 10 can be measured, a boom angle sensor 30 is mounted to a boom pin, an arm angle sensor 31 is mounted to an arm pin, and a bucket angle sensor 32 is mounted to a bucket link 13. Mounted to the upper swing structure 12 is a machine body inclination angle sensor 33 detecting an inclination angle $\theta$ (see FIG. 4) in the front-rear direction of the upper swing structure 12 (the machine body 1B) with respect to a reference surface (for example, a horizontal surface).

As shown in FIG. 2, the hydraulic excavator 1 of FIG. 1 has: the hydraulic pump 2; a plurality of hydraulic actuators including the boom cylinder 5, the arm cylinder 6, the bucket cylinder 7, the swing hydraulic motor 4, and the left and right traveling motors 3*a* and 3*b*, which driven by the hydraulic fluid from the hydraulic pump 2; the traveling right lever 23*a*, the traveling left lever 23*b*, the operation right lever 1*a*, and the operation left lever 1*b*, which are correspondingly provided with the respective hydraulic actuators 3 through 7; a plurality of flow control valves 15*a* through 15*f* connected between the hydraulic pump 2 and the plurality of actuators 3 through 7, the flow control valves 15*a* through 15*f* being controlled by control signals output from the operation devices 45*a*, 45*b*, 46*a*, 46*b*, 47*a*, and 47*b* in accordance with the operation amount and operational direction of the operation levers 1 and 23 to control the flow rate and direction of the hydraulic fluid supplied to the hydraulic actuators 3 through 7; and a relief valve 16 configured to be opened when the pressure between the hydraulic pump 2 and the flow control valves 15*a* through 15*f* becomes a set value or more. These constitute a hydraulic drive system driving the driven members of the hydraulic excavator 1.

The hydraulic excavator of the present embodiment is equipped with a control system aiding the excavation operation of the operator. More specifically, there is provided an excavation control system which, in the case where an excavation operation (more specifically, an order for arm crowding, bucket crowding, or bucket dumping) is input via the operation devices 45*b* and 46*a*, executes control to forcibly operating at least one of the hydraulic actuators 5, 6, and 7 (for example, to extend the boom cylinder 5 to forcibly perform boom raising operation) such that the position of the forward end of the work implement 1A (the claw tip of the bucket 10) is maintained on the target surface and in a region above the same based on the positional relationship between the target surface and the work implement 1A. In the present specification, this control is sometimes referred to as "the area limiting control." Due to this control, the claw tip of the bucket 10 is prevented from getting beyond the target surface, so that it is possible to perform excavation along the target surface independently of the skill of the operator. In the present embodiment, the control point related to the area limiting control is set to the claw tip of the bucket 10 of the hydraulic excavator (the forward end of the work implement 1A). The control point may also be a point other than the bucket claw tip so long as it is a point at the forward end portion of the work implement 1A. For example, it is also possible to select the bottom surface of the bucket 10 or the outermost portion of the bucket link (not shown).

This excavation control system capable of executing the area limiting control is equipped with: a limiting control switch 17 which is installed in the cab at a position where it does not interfere with the field of vision of the operator such as a position above the operation panel and which switches between effective and invalid in the area limiting control; pressure sensors 70*a* and 70*b* which are provided in the pilot lines 144*a* and 144*b* of the operation device 45*a* for the boom 8 and which detect a pilot pressure (control signal) as the operation amount of the operation lever 1*a*; pressure sensors 71*a* and 71*b* which are provided in the pilot lines 145*a* and 145*b* of the operation device 45*b* for the arm 9 and which detect a pilot pressure (control signal) as the operation amount of the operation lever 1*b*; a solenoid proportional valve 54*a* a primary port side of which is connected to the pilot pump 48 and which reduces and outputs the pilot pressure from the pilot pump 48; a shuttle valve 82 which is connected to the pilot line 144*a* of the operation device 45*a* for the boom 8 and a secondary port side of the solenoid proportional valve 54*a* and which selects the higher of the pilot pressure in the pilot line 144*a* and the control pressure output from the solenoid proportional valve 54*a* and guides it to the hydraulic drive section 150*a* of the flow control valve 15*a*; a solenoid proportional valve 54*b* which is installed in the pilot line 144*b* of the operation device 45*a* for the boom 8 and which reduces and outputs the pilot pressure in the pilot line 144*b* in accordance with an electric signal; and a controller 40 which is a computer capable of executing the area limiting control.

Provided in the pilot lines 145*a* and 145*b* for the arm 9 are pressure sensors 71*a* and 71*b* detecting the pilot pressure and outputting it to the controller 40, and solenoid proportional valves 55*a* and 55*b* reducing and outputting the pilot pressure based on a control signal from the controller 40. Provided in the pilot lines 146*a* and 146*b* for the bucket 10 are pressure sensors 72*a* and 72*b* detecting the pilot pressure and outputting it to the controller 40, and solenoid proportional valves 56*a* and 56*b* reducing and outputting the pilot pressure based on a control signal from the controller 40. In FIG. 2, the connection line between the pressure sensors 71 and 72, the solenoid proportional valves 55 and 56, and the controller 40 is omitted for want of space.

While in this example the solenoid proportional valve 54*a* and the shuttle valve 82 generating a pilot pressure even in the case where there is no operation of the operation device 45*a* are installed solely in the pilot line 144*a*, it is also possible to install them in the other pilot lines 144*b*, 145, and 146 related to the boom cylinder 5, the arm cylinder 6, and the bucket cylinder 7 and to generate a pilot pressure therein. Further, a solenoid proportional valve reducing and outputting the pilot pressure output from the operation device 45*a*, which is similar to the solenoid proportional valve 54*b* of the pilot line 144*b*, may also provided in the pilot line 144*a*.

Input to the controller 40 are the configuration information and positional information of the target surface stored in an ROM 93 or an RAM 94 described below, detection signals of the angle sensors 30 through 32 and the inclination angle sensor 33, and detection signals of the pressure sensors 70 through 72. Further, the controller 40 outputs an electric signal effecting correction of a control signal (pilot pressure) for conducting an area limiting excavation control (area limiting control) to the solenoid proportional valves 54 through 56.

Figure 3:
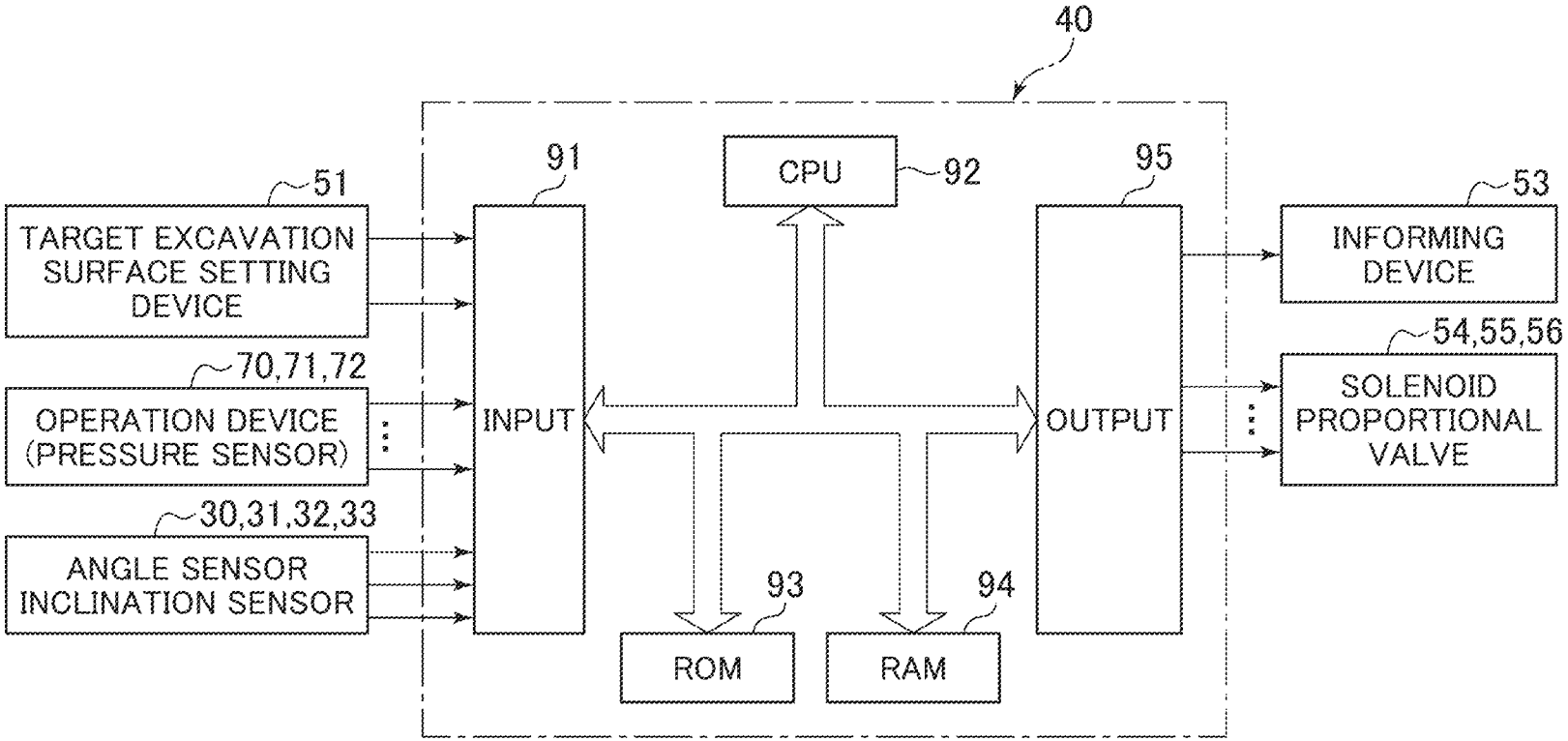
FIG. 3 is a diagram illustrating the hardware structure of the controller.

FIG. 3 shows the hardware configuration of the controller 40. The controller 40 has an input section 91, a central processing unit (CPU) 92 which is a processor, a read-only memory (ROM) 93 and a random-access memory (RAM) 94, and an output section 95. The input section 91 inputs signals from the operation devices 45 through 47, a signal from a setting device 51 for setting the target surface, and signals from the angle sensors 30 through 32 and the inclination angle sensor 33, and effects A/D conversion. The ROM 93 is a storage medium storing a control program for executing the area limiting control including the processing related to the flowcharts of FIGS. 8 and 12 described below and various items of information, etc. necessary for executing the flowcharts. The CPU 92 performs predetermined computation processing with respect to signals taken in from the input section 91 and the memories 93 and 94 in accordance with a control program stored in the ROM 93. The output section 95 prepares an output signal in accordance with the computation result of the CPU 92, and outputs the signal to the solenoid proportional valves 54 through 56 and the informing device 53, thereby driving/controlling the hydraulic actuators 4 through 7, and displaying images of the machine body 1B, the bucket 10, the target surface, etc. on the display screen of a monitor which is the informing device 53. While the controller 40 of FIG. 3 is equipped with semiconductor memories, the ROM 93 and the RAM 94, as the storage devices, they may be replaced by other memories so long as they are storage devices. For example, there may be provided a magnetic storage device such as a hard disk drive.

Figure 5:
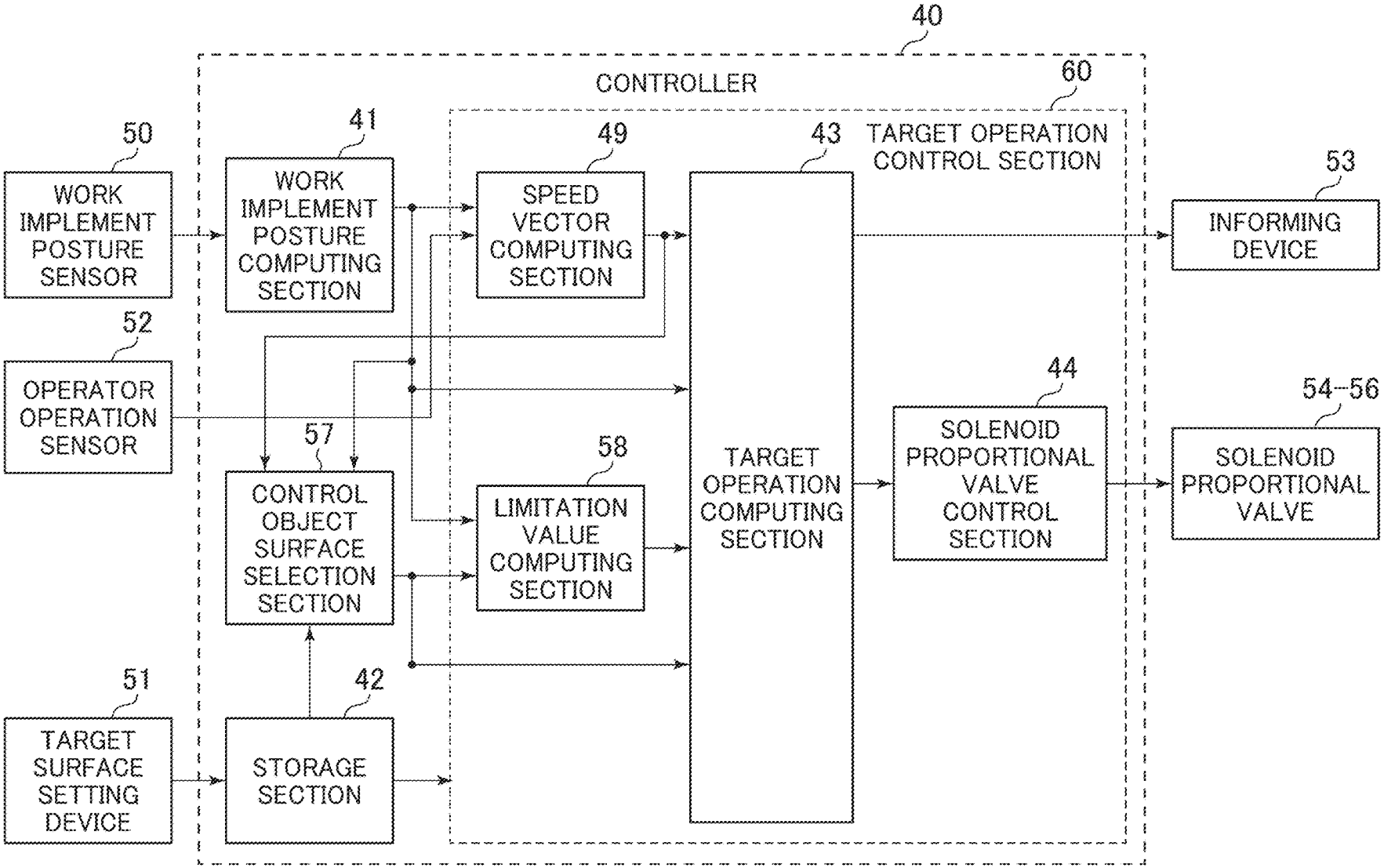
FIG. 5 is a functional block diagram illustrating a controller according to a first embodiment.

FIG. 5 is a functional block diagram illustrating the controller 40 according to an embodiment of the present invention. The controller 40 is equipped with a work implement posture computing section 41, a configuration storage section 42, a target operation computing section 43, a solenoid proportional valve control section 44, a speed vector computing section 49, a control object surface selection section 57, and a limitation value computing section 58. Of these, the speed vector computing section 49, the limitation value computing section 58, the target operation computing section 43, and the solenoid proportional valve control section 44 are sometimes generally referred to as the "target operation control section 60." Further, connected to the controller 40 are the work implement posture sensor 50, the target surface setting device 51, the operator operation sensor 52, the informing device 53, and the solenoid proportional valves 54 through 56.

The work implement posture sensor 50 is composed of the boom angle sensor 30, the arm angle sensor 31, the bucket angle sensor 32, and the machine body inclination angle sensor 33.

The target surface setting device 51 is an interface that can input information on the target configuration (including positional information on the target surfaces and the inflection points constituting the target configuration, and inclination angle information on the target surfaces). The target configuration is defined by connecting a plurality of target surfaces. In the present embodiment, the inclination angles of the two adjacent target surfaces are different from each other, and the connection point of the two target surfaces is referred to as the inflection point. In the following, the inflection point situated at the upper end of the face of slope may be referred to as the "top of slope," and the inflection point situated at the lower end of the face of slope may be referred to as the "foot of slope." The target configuration may be input via the target surface setting device 51 via the target surface setting device 51 manually by the operator, or may be taken in from the outside via a network or the like.

Further, connected to the target surface setting device 51 is a satellite communications antenna such as a GNSS receiver (not shown). When data communication is possible between the external terminal storing the three-dimensional data of the target configuration determined in a global coordinate system and the excavator, it is possible to retrieve the target configuration corresponding to the excavator position in the three-dimensional data of the external terminal based on the global coordinates of the excavator specified by the satellite communications antenna.

The operator operation sensor 52 is composed of pressure sensors 70*a*, 70*b*, 71*a*, 71*b*, 72*a*, and 72*b* gaining the operation pressure generated through the operation of the operation lever 1 by the operator. It is possible to calculate the operation amounts of the operation devices 45*a*, 45*b*, and 46*a* from the detection values of the pressure sensors 70, 71, and 72. It is possible to calculate the operational speeds of the hydraulic cylinders 5, 6, and 7 from the operation amounts, the characteristics of the flow control valves 15*a*, 15*b*, and 15*c*, the capacity (tilting angle) of the hydraulic pump 2, and the delivery pressure. The calculation of the operation amount by the pressure sensors 70, 71, and 72 (pilot pressures) is only given by way of example. For example, it is also possible to detect the operation amount of the operation lever by a position sensor (e.g., a rotary encoder) detecting the rotational displacement of the operation levers of the operation devices 45*a*, 45*b*, and 46*a*. Further, instead of calculating the operational speed from the operation amount, it is also possible to mount stroke sensors detecting the expansion/contraction amounts of the hydraulic cylinders 5, 6, and 7, and to calculate the operational speed of each cylinder based on the change with passage of time of the expansion/contraction amount detected.

The informing device 53 is formed by at least one of a display (display device) displaying the target configuration or the positional relationship between the control object surface and the work implement 1A to the operator, and a speaker informing of the target configuration or the positional relationship between the control object surface and the work implement 1A through sound (including voice).

The solenoid proportional valves 54 through 56 are provided in the hydraulic line of the pilot pressure (operation pressure) described with reference to FIG. 2. Of these, the solenoid proportional valves 54*b*, 55*a*, 55*b*, 56*a*, and 56*b* are capable of reducing the operation pressure generated through the lever operation by the operator on the downstream side. The solenoid proportional valve 54*a* is capable of generating the operation pressure without the lever operation by the operator.

Figure 4:
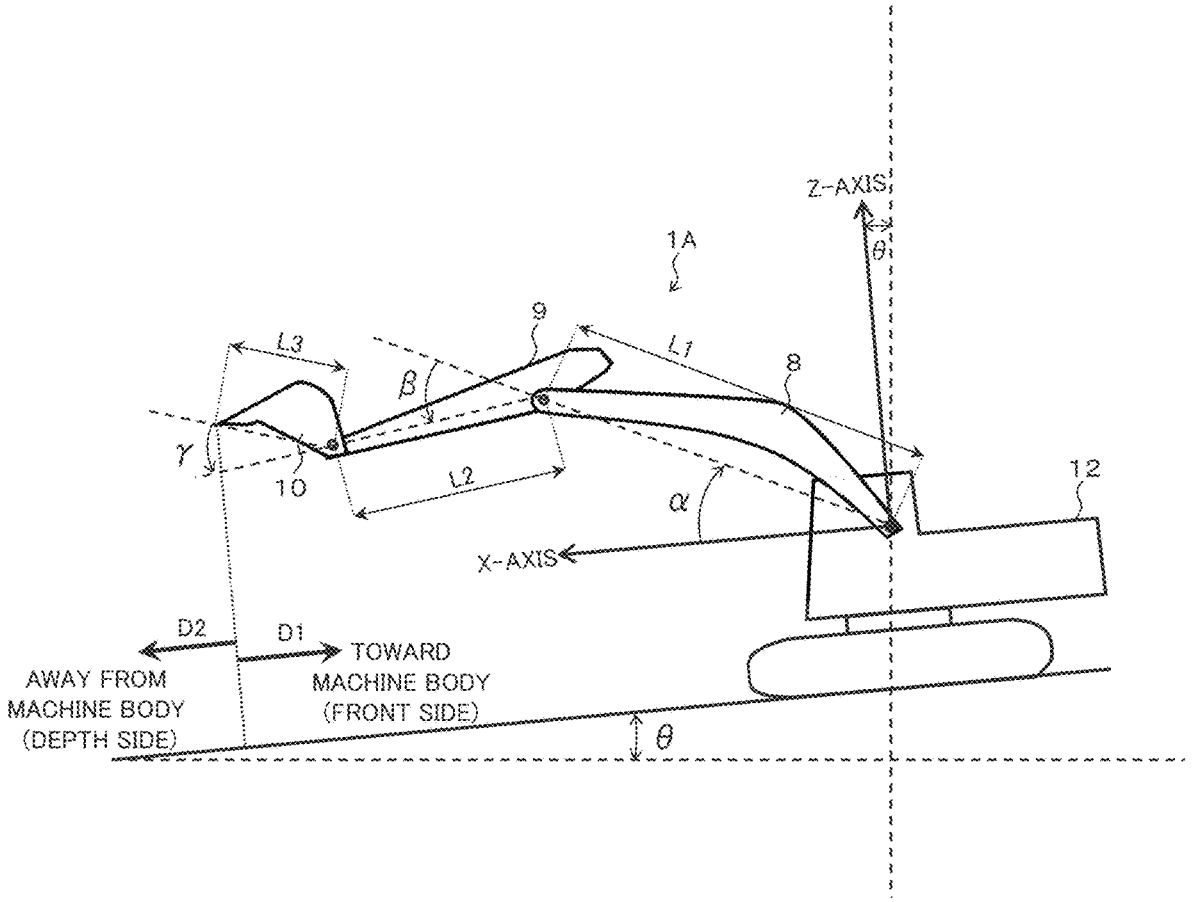
FIG. 4 is a diagram illustrating a coordinate system in the hydraulic excavator.

The work implement posture computing section 41 computes the posture of the work implement 1A based on the information from the work implement posture sensor 50. The posture of the work implement 1A can be defined in the excavator reference coordinate system of FIG. 4. The excavator reference coordinate system of FIG. 4 is a coordinate system set on the upper swing structure 12. The bottom portion of the boom 8 rotatably supported by the upper swing structure 12 is used as the origin. The Z-axis is set in the vertical direction of the upper swing structure 12, and the X-axis is set in the horizontal direction thereof. The inclination angle of the boom 8 with respect to the X-axis is the boom angle $\alpha$, the inclination angle of the arm 9 with respect to the boom 8 is the arm angle $\beta$, and the inclination angle of the bucket claw tip with respect to the arm is the bucket angle $\gamma$. The inclination angle of the machine body 1B (upper swing structure 12) with respect to the horizontal surface (reference surface) is the inclination angle $\theta$. The boom angle $\alpha$ is detected by the boom angle sensor 30, the arm angle $\beta$ is detected by the arm angle sensor 31, the bucket angle $\gamma$ is detected by the bucket angle sensor 32, and the inclination angle $\theta$ is detected by the machine body inclination angle sensor 33. As determined in FIG. 4, assuming that the respective lengths of the boom 8, the arm 9, and the bucket 10 are L1, L2, and L3, the coordinates of the bucket claw tip position in the excavator reference coordinate system and the posture of the work implement 1A can be expressed by L1, L2, L3, $\alpha$, $\beta$, and $\gamma$.

Figure 7:
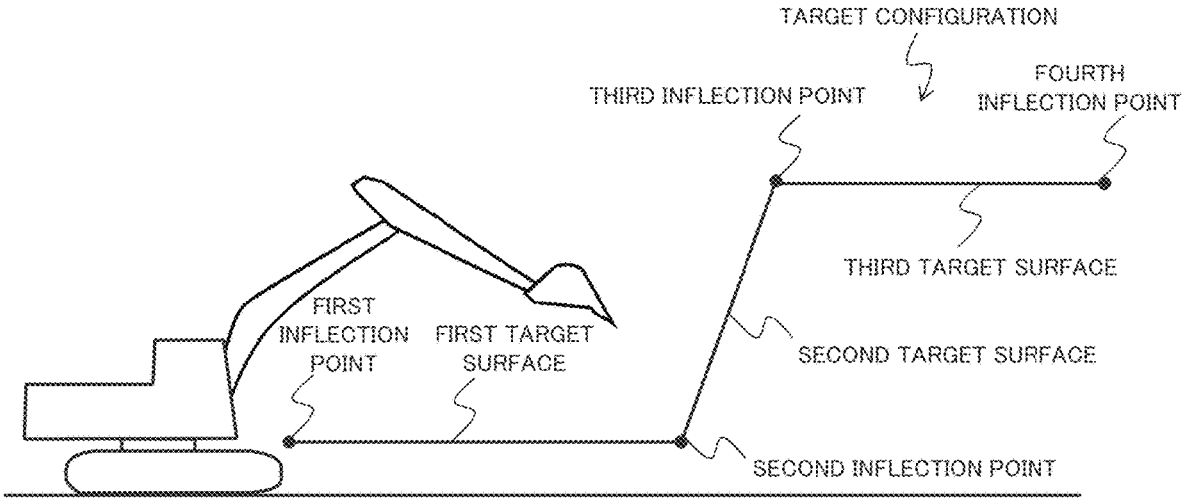
FIG. 7 is an explanatory view illustrating a target configuration.

The storage section 42 is provided in the ROM 93, and stores the target configuration based on the information from the target surface setting device 51. Here, as shown in FIG. 7, a sectional configuration obtained by cutting a three-dimensional target configuration by a plane in which the work implement 1A moves (operational plane of the work implement) is used as a target configuration (two-dimensional target configuration). The inflection points on the target configuration are a first inflection point, a second inflection point, a third inflection point, . . . , an ith inflection point (i=1, 2, 3, . . . n) in the order of closeness to the machine body. The target surfaces are a first target surface formed by the first inflection point and the second inflection point, a second target surface formed by the second inflection point and the third inflection point, . . . an ith target surface formed by the ith inflection point and the (i+1)th inflection point (i=1, 2, 3, . . . n−1) in the order of closeness to the machine body.

Based on the information from the work implement posture computing section 41, the information on the target configuration stored in the storage section 42, etc., the control object surface selection section 57 selects one target surface (control object surface) suitable for the use in the area limiting control from among the plurality of target surfaces constituting the target configuration in accordance with the situation. Here, the selected control object surface is output to a portion where it is required such as the limitation value computing section 58. Next, the method of selecting the control object surface by the control object surface selection section 57 will be described with reference to FIG. 8.

Figure 8:
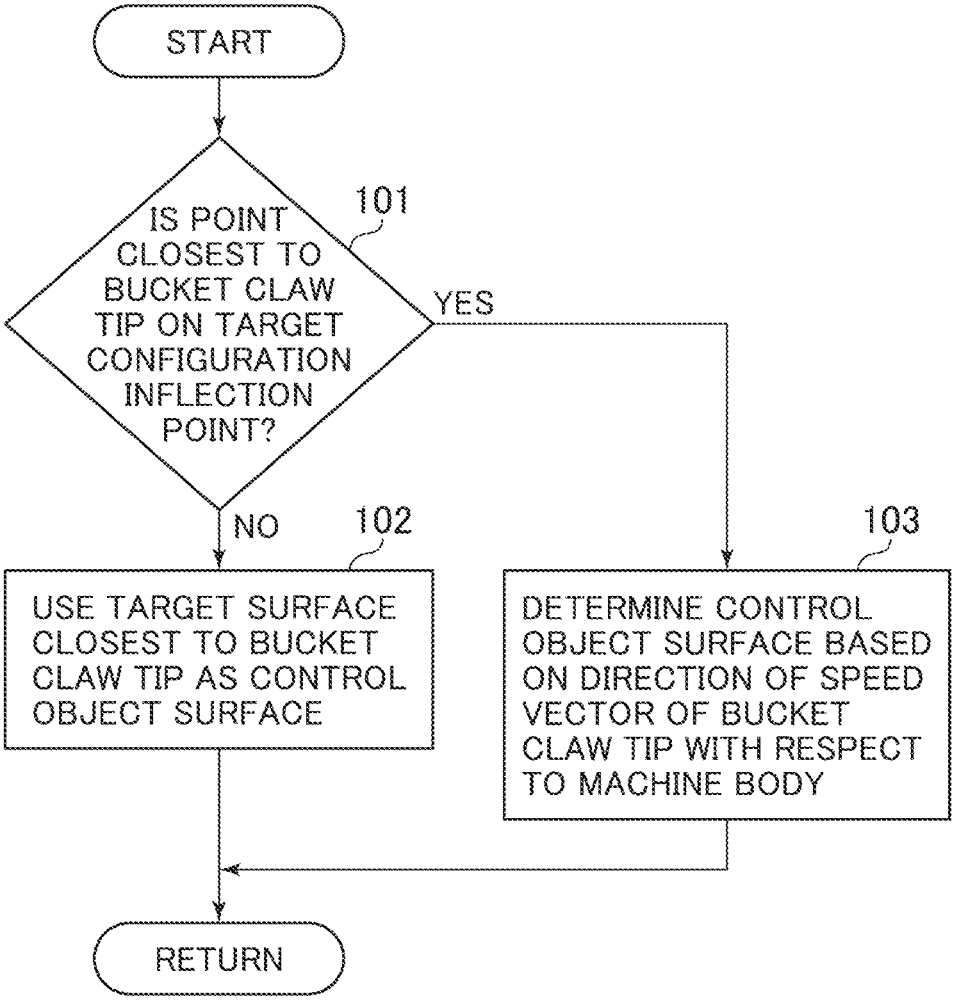
FIG. 8 is a flowchart according to which the controller according to the first embodiment selects the control object surface.

FIG. 8 is a flowchart according to which the control object surface selection section 57 according to the present embodiment selects the control object surface. In the case where the power source of the controller 40 is ON and where the limiting control switch 17 is ON (effective), the control object surface selection section 57 starts the processing of the flowchart of FIG. 8.

In step 101, it is determined whether or not the point closest to the bucket claw tip on the target configuration is an inflection point. In the case where, as a result of the determination, the point closest to the bucket claw tip is not an inflection point (that is, in the case where the determination result is "NO"), the procedure advances to step 102, and the target surface closest to the bucket claw tip on the target configuration serves as the control object surface.

On the other hand, in the determination of step 101, in the case where the point closest to the bucket claw tip is an inflection point (that is, in the case where the determination result is "YES"), in step 103, of the two target surfaces connected to the inflection point, the control object surface is determined based on the direction of the speed vector of the bucket claw tip due to the operator operation with respect to the machine body (hydraulic excavator 1) input from the speed vector computing section 49 (described below). More specifically, in the excavator reference coordinate system in FIG. 4, in the case where the speed vector of the claw tip has a component in the direction toward the machine body (D1), of the two target surfaces, the target surface closer to the machine body is used as the control object surface. In contrast, in the coordinate system, in the case where the speed vector of the claw tip has a component in the direction away from the machine body (D2), of the two target surfaces, the target surface farther from the machine body is used as the control object surface. In this case, for example, in the coordinate system, the horizontal direction component of the speed vector of the claw tip is extracted. In the case where the horizontal direction component is toward the machine body, the one closer to the machine body may be used as the control object surface, and in the case where the horizontal direction component is away from the machine body, the one farther from the machine body may be used as the control object surface. Here, instead of the horizontal direction component of the speed vector of the bucket claw tip due to the operator operation, it is also possible to utilize the horizontal direction component of the speed vector of the actual bucket claw tip computed by the target operation computing section 43. Further, as in step 210 of FIG. 12 of the second embodiment described below, of the two target surfaces connected to the nearest inflection point, the one closer to the bucket claw tip may be used as the control object surface.

The speed vector computing section 49 computes the speed vector of the claw tip of the bucket 10 due to the operator operation based on the posture of the work implement 1A and the position of the bucket claw tip from the work implement posture computing section 41, and the operational speeds of the cylinders 5, 6, and 7 calculated based on the input from the operator operation sensor 52.

Figure 6:
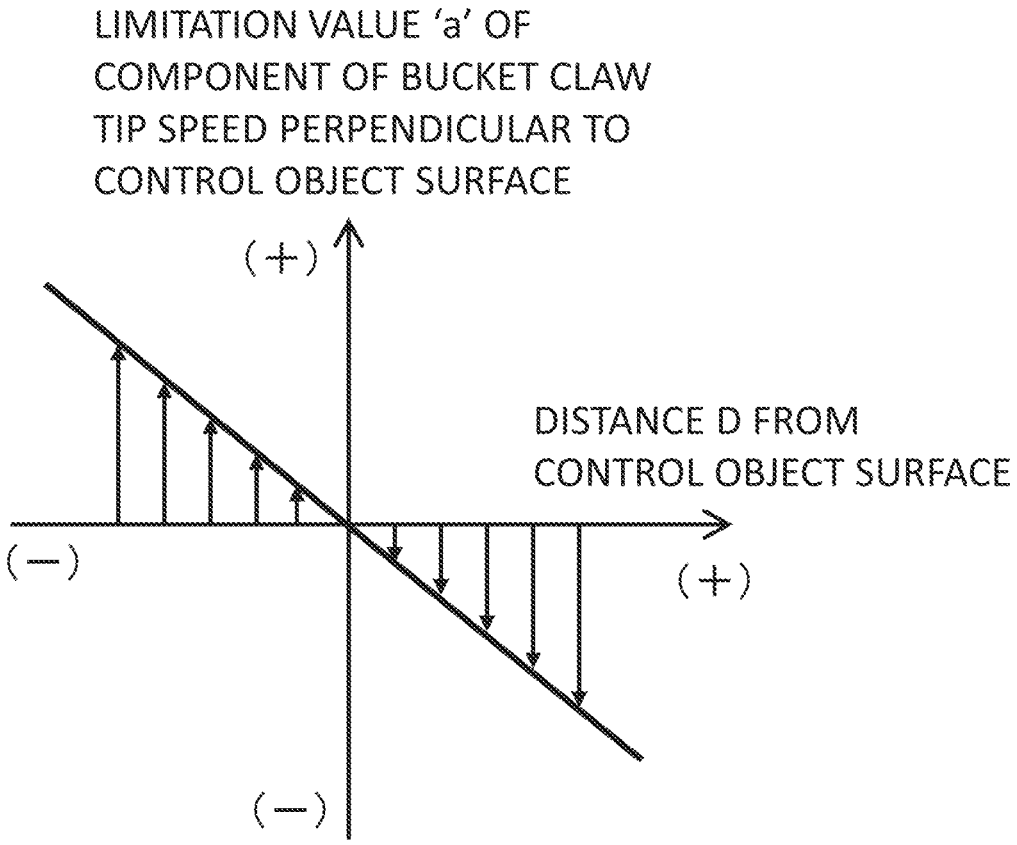
FIG. 6 is a diagram illustrating the relationship between a limitation value 'a' of a vertical component of a bucket claw tip speed and a distance D from a control object surface.

The limitation value computing section 58 calculates the limitation value 'a' of the component of the speed vector of the bucket claw tip vertical to the control object surface based on the distance D from the claw tip of the bucket 10 to the target surface of the control object (control object surface) (in the following, the component vertical to the control object surface may be abbreviated to the "vertical component"). In calculating the limitation value 'a,' a function, a table or the like in which the relationship between the limitation value 'a' and the distance D is defined as shown in FIG. 6 is stored in the ROM 93 of the controller 40, and this relationship is read as appropriate. The distance D can be calculated from the position (coordinates) of the claw tip of the bucket 10 calculated by the work implement posture computing section 41, and the distance of the straight line including the control object surface stored in the storage section 42. It is desirable for the relationship between the limitation value 'a' and the distance D to exhibit a characteristic in which the limitation value 'a' decreases monotonously with the increase of the distance D. The relationship, however, is not restricted to the one as shown in FIG. 6. For example, the limitation value 'a' may be maintained at an individual predetermined value when the distance D is not less than a positive predetermined value or not more than a negative predetermined value, or the relationship between the limitation value 'a' and the distance D may be defined by a curve.

In FIG. 6, the horizontal axis indicates the distance D of the bucket claw tip from the control object surface, and the vertical axis indicates the limitation value 'a' of the component of the bucket claw tip speed vertical to the control object surface. In the case where the distance D indicated by the horizontal axis is (+), the bucket claw tip is situated above the control object surface, and in the case where it is negative, the bucket claw tip is situated under the control object surface. In the case where the limitation value 'a' of the vertical axis is positive, the limitation value 'a' is directed vertically upwards, and in the case where it is negative, the limitation value is directed vertically downwards. The relationship between the distance D and the limitation value 'a' is determined as follows: When the bucket claw tip is above the control object surface, the speed in the (−) direction of the magnitude in proportion to the distance D is used as the limitation value 'a,' and when the bucket claw tip is under the control object surface, the speed in the (+) direction of the magnitude in proportion to the distance D is used as the limitation value 'a.'

The target operation computing section 43 computes the target operations of the hydraulic cylinders 5, 6, and 7 such that the vertical component of the speed vector of the bucket claw tip is controlled in accordance with the limitation value 'a' input from the limitation value computing section 58. In the case where it is determined that the target operation cannot be realized with the operation amount (pilot pressure) computed from the output of the operator operation sensor 52, there is output to the solenoid proportional valve control section 44 a command to correct the pilot pressure acting on the flow control valves 15*a*, 15*b*, and 15*c* to a value making it possible to realize the target operation. More specifically, the target operation computing section 43 in the present embodiment outputs a command to the solenoid proportional valve control section 44 as in the following (a) through (d).

(a) In the case where the claw tip is under the control object surface and where the vertical component of the bucket claw tip speed due to the operator operation computed by the speed vector computing section 49 is directed downwards ((−) direction), there is output to the solenoid proportional valve control section 44 a command to drive the solenoid proportional valve 54*a* such that there is conducted the boom raising operation setting the vertical component of the bucket claw tip speed to the limitation value (upwardly directed). That is, in this case, the control value 'a' is adopted as the vertical component of the bucket claw tip speed.

(b) In the case where the claw tip is under the control object surface and where the vertical component of the bucket claw tip speed due to the operator operation computed by the speed vector computing section 49 is directed upwards ((+) direction), when the magnitude of the vertical component of the bucket claw tip speed computed by the speed vector computing section 49 is less than the limitation value 'a,' there is output to the solenoid proportional valve control section 44 a command to drive the solenoid proportional valve 54*a* such that there is conducted the boom raising operation the vertical component of the bucket claw tip speed is increased to the limitation value. That is, in this case, as the vertical component of the bucket claw tip speed, there is adopted, one of the vertical component of the bucket claw tip speed due to operator operation and the limitation value 'a,' which one having a larger absolute value. It is also possible to add to the pilot lines 145 and 146 the above-described structure for generating a pilot pressure, and to output to the solenoid proportional valve control section 44 a command to perform at least one of the arm crowding operation, arm dumping operation, bucket crowding operation, and bucket dumping operation increasing the vertical component of the bucket claw tip speed in addition to or instead of the boom raising operation.

(c) In the case where the claw tip is above the control object surface and where the vertical component of the bucket claw tip speed due to the operator operation computed by the speed vector computing section 49 is directed downwards ((−) direction), when the magnitude (absolute value) of the vertical component of the bucket claw tip speed due to the operator operation computed by the speed vector computing section 49 is more than the magnitude (absolute value) of the limitation value 'a,' there is output to the solenoid proportional valve control section 44 a command to drive the solenoid proportional valve 54*a* such that there is conducted the boom raising operation setting the vertical component of the bucket claw tip speed is decreased to the limitation value 'a.' That is, in this case, as the vertical component of the bucket claw tip speed, there is adopted, one of the vertical component of the bucket claw tip speed due to operator operation and the limitation value 'a,' which one having a smaller absolute value.

In the case where the claw tip is above the control object surface and where the vertical component of the bucket claw tip speed due to the operator operation computed by the speed vector computing section 49 is directed upwards ((+) direction), there is output to the solenoid proportional valve control section 44 a command not to drive the solenoid proportional valve 54*a* such that the operator operation may be conducted as it is. That is, in this case, the vertical component of the bucket claw tip speed due to operator operation is adopted as the vertical component of the bucket claw tip speed.

On the control object surface, the limitation value 'a' is zero, and the vertical component of the bucket claw tip speed is maintained at zero through the control of the target operation computing section 43 and the solenoid proportional valve control section 44, so that when, for example, the arm 9 is caused to perform crowding operation in the vicinity of the control object surface, an excavation operation along the control object surface is realized due to the horizontal component of the bucket claw tip speed.

In the case where the claw tip is above the control object surface and where the crowding operation of the arm 9 is performed by the operator, in order to achieve an improvement in terms of excavation accuracy, the speed of the arm 9 may be reduced as needed by the solenoid proportional valve 55. Further, in order that the angle of the back surface of the bucket 10 with respect to the control object surface may be of a fixed value, and that the leveling work may be facilitated, the bucket 10 may be caused to rotate in the dumping direction through the control of the solenoid proportional valve 56.

The function by which, as described above, the actuator is controlled automatically or semi-automatically with respect to the operation amount of the operation lever 1 by the operator and by which the work implements such as the boom 8, the arm 9, the bucket 10, and the upper swing structure 12 are operated is referred to as machine control. The area limiting control is an example of machine control.

The solenoid proportional valve control section 44 computes the command to the solenoid proportional valves 54 through 56 based on the command from the target operation computing section 43. The solenoid proportional valves 54 through 56 are controlled based on the command from the solenoid proportional valve control section 44. Examples of the command output from the target operation computing section 43 to the solenoid proportional valve control section 44 include the boom raising command. The boom raising command is a command output to the solenoid proportional valve control section 44 when, at the time of execution of the area limiting control, the boom 8 is forcibly raised such that the position of the claw tip of the bucket 10 may be maintained on the target surface and in a region above the same. When the boom raising command is input, the solenoid proportional valve control section 44 outputs a valve-opening command (command current) to the solenoid proportional valve 54*a*, and the hydraulic fluid (hereinafter referred to as the secondary pressure) generated in the solenoid proportional valve 54*a* is supplied to the hydraulic drive section 150*a* and the control valve 15*a* is driven. As a result, the hydraulic working fluid is guided from the hydraulic pump 2 to the bottom side hydraulic chamber of the boom cylinder 5, and the boom 8 rises. The rising speed of the boom 8 in this process (the boom raising speed) can be controlled by the value of the secondary pressure of the solenoid proportional valve 54*a*, that is, by the command from the solenoid proportional valve control section 44 to the solenoid proportional valve 54*a*.

Based on the information from the target operation computing section 43, the informing device 53 notifies the operator of various items of information related to the machine control.

Next, the features of the work machine (hydraulic excavator) according to the present embodiment will be described. In the above embodiment, the work machine is equipped with: the multi-joint type work implement 1A; the plurality of hydraulic cylinders (hydraulic actuators) 5, 6, and 7 driving the work implement 1A; the operation devices 45*a*, 45*b*, and 46*a* outputting an operation signal (pilot pressure) to the plurality of hydraulic cylinders 5, 6, and 7; the storage section 42 storing a target configuration defined by connecting a plurality of target surfaces; the control object surface selection section 57 selecting the target surface closest to the control point (bucket claw tip) set at the forward end portion of the work implement 1A of the target configuration as the control object surface; and the target operation control section 60 which, in the case where the excavation operation is input by the operator via the operation devices 45*a*, 45*b*, and 46*a*, controls the plurality of hydraulic cylinders 5, 6, and 7 such that the operational range of the work implement 1A is limited to the control object surface and the region above the same.

Figure 9:
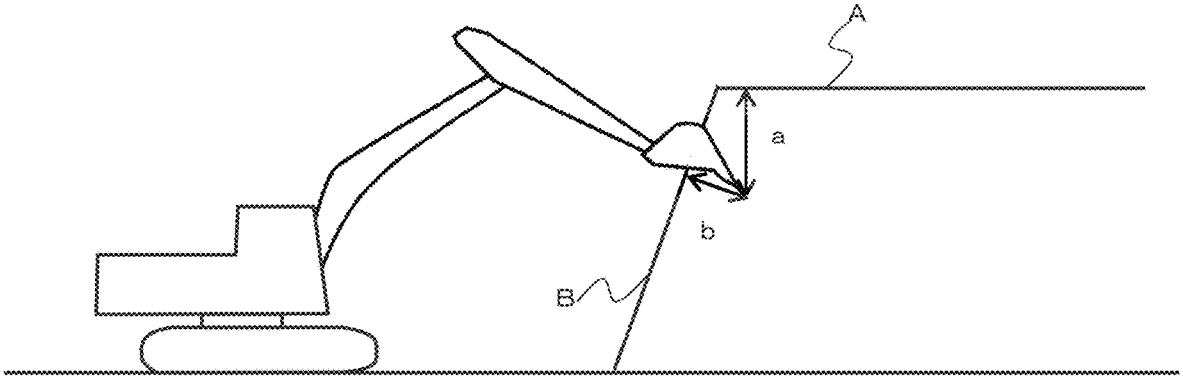
FIG. 9 is an explanatory view illustrating the effect of a work machine according to the first embodiment.

The effect of the work machine constructed as described above will be described with reference to FIG. 9. The target configuration shown in FIG. 9 is defined by continuous target surfaces A and B. The diagram illustrates how the hydraulic excavator excavates the target surfaces A and B.

First, as a comparative example of the present embodiment, there will be taken the case where the hydraulic excavator of FIG. 9 adopts a control in which it selects from among the plurality of target surfaces constituting the target configuration the target surface situated either vertically above or under the bucket claw tip as the control selection surface. Suppose, when the bucket claw tip is situated above the target surface B and when excavation through area limiting control is being excavated on the target surface B as the control object surface, the control accuracy deteriorates and the claw tip of the bucket 10 intrudes under the target surface B. At this time, in the case where the inclination angle of the target surface B with respect to the horizontal surface is large as in the case of FIG. 9, the bucket claw tip is likely to intrude under the target surface A even when the intrusion amount on the target surface B is relatively small. Thus, there is much fear of the control object surface being changed to the target surface A even during the excavation of the target surface B. In the case of FIG. 9, the bucket claw tip intrudes under the target surface A, so that the control object surface is changed to the target surface A against the actual work and the will of the operator. In this case, the intrusion amount a with respect to the target surface A is larger than the intrusion amount b with respect to the target surface B, so that the forcible boom raising is allowed to be executed at the limitation value 'a' which is larger than that when the control object surface is the target surface B. This operation causes the operator to experience great discomfort.

In contrast, in the present embodiment, the target surface closest to the bucket claw tip on the target configuration is selected as the control object surface by the control object surface selection section 57. Thus, as shown in the drawing, even if the control accuracy deteriorates and the claw tip of the bucket 10 intrudes under the target surface B while excavation is being executed through area limiting control on the target surface B as the control object surface, the target surface B of smaller intrusion amount continues to be selected as the control object surface. Thus, according to the present embodiment, in the case where a target configuration defined by a plurality of target surfaces of different inclination angles is continuously excavated, even if the bucket claw tip erroneously intrudes under the control object surface, the proper target surface is selected as the control object surface, so that the discomfort imparted to the operator is mitigated. Further, it is possible to prevent intrusion of the work implement under the target surface.

Figure 17:
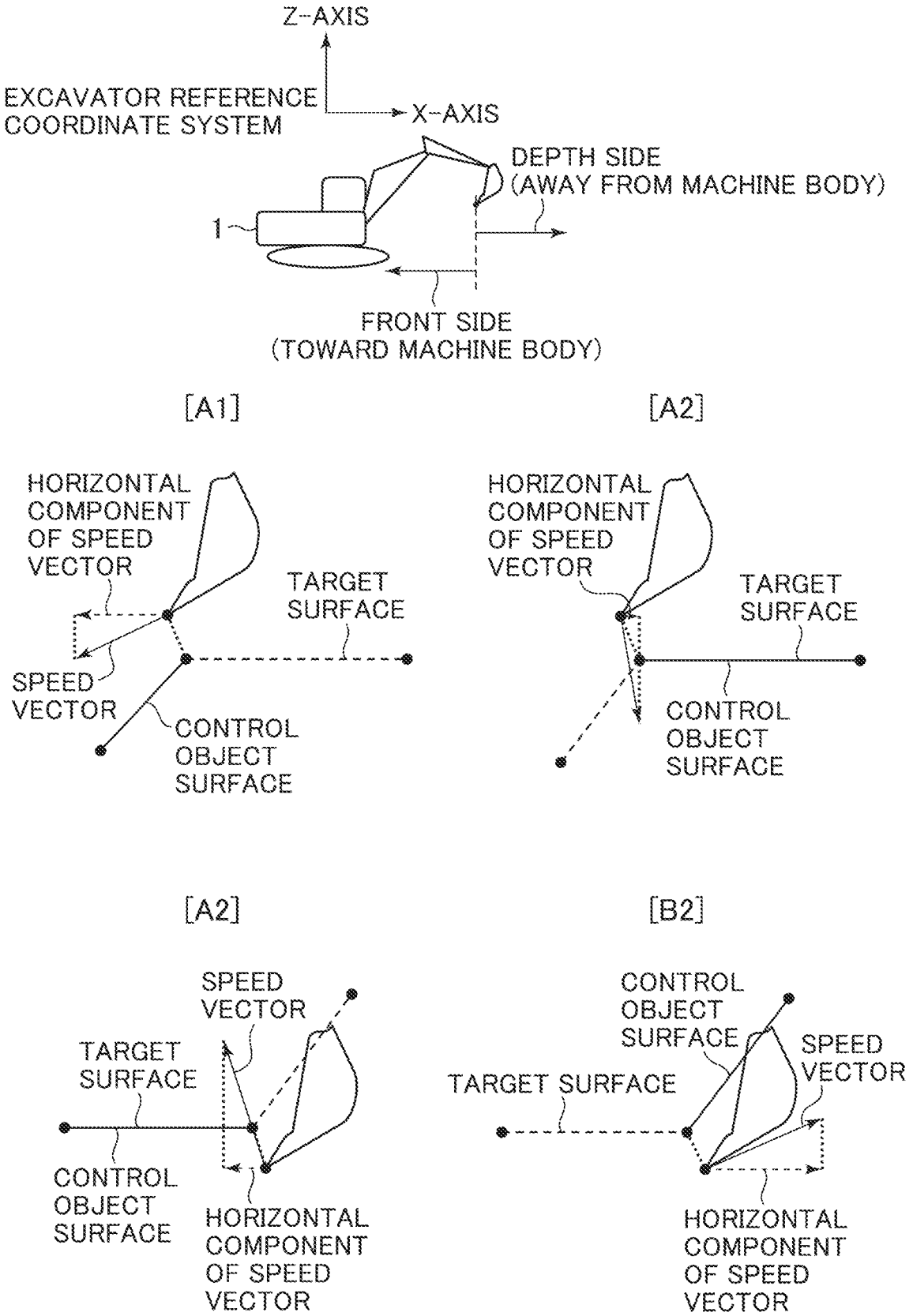
FIG. 17 is an explanatory view illustrating step 103 in the flowchart of FIG. 8.

In the case where the point closest to the bucket claw tip is an inflection point, the distances from the bucket claw tip to the two target surfaces are equal to each other, so that the control object surface cannot be determined by the above method based on the distance. In view of this, in the present embodiment, in the case where the point closest to the bucket claw tip is an inflection point, of the two target surfaces connected to the inflection point, the control object surface is determined based on the direction of the speed vector of the bucket claw tip due to operator operation with respect to the machine body (see step 103). More specifically, as shown in FIG. 17, the control object surface is determined based on whether the direction of the horizontal component of the speed vector of the claw tip is toward the machine body or away from the machine body. In FIG. 17, the direction to the left is "the direction toward the machine body" and the direction to the right is "the direction away from the machine body." In the case of portions A1 and A2 of FIG. 17, the bucket claw tip is situated under the target configuration, and in the case of portions B1 and B2, the bucket claw tip is situated above the target configuration (target surface). In the case of portions A1 and B1, the horizontal component of the speed vector of the claw tip is toward the machine body, so that the target surface on the front side is set as the control object surface. On the other hand, in the case of portions A2 and B2, the horizontal component of the speed vector of the claw tip is away from the machine body, so that the target surface on the depth side is set as the control object surface. In this way, in the present embodiment, the target surface in the moving direction of the bucket claw tip is selected as the control object surface, so that, even in the case where the point closest to the claw tip is an inflection point, the control object surface is continuously selected to stabilize the area limiting control.

While in the example described above the target configuration is defined by a target surface of a large inclination angle so as to facilitate the understanding of the effect of the present embodiment, the effect of allowing selection of an optimum target surface as the control object surface by using the target surface of the minimum intrusion amount (the distance from the bucket claw tip to the target surface) as the control object can be attained independently of the magnitude of the inclination angle.

Second Embodiment

In the first embodiment, the control point of the area limiting control (the point used as the reference of the distance D when calculating the limitation value 'a' by the limitation value computing section 58) is set to a specific point (that is, the bucket forward end). In the second embodiment, a point selected as appropriate in accordance with the situation from a segment extracted from the contour of the sectional configuration of the forward end portion of the work implement 1A due to the operational plane (a point that can move in the segment) is used as the control point. In the following, the segment is sometimes referred to as the "control line."

Figure 10:
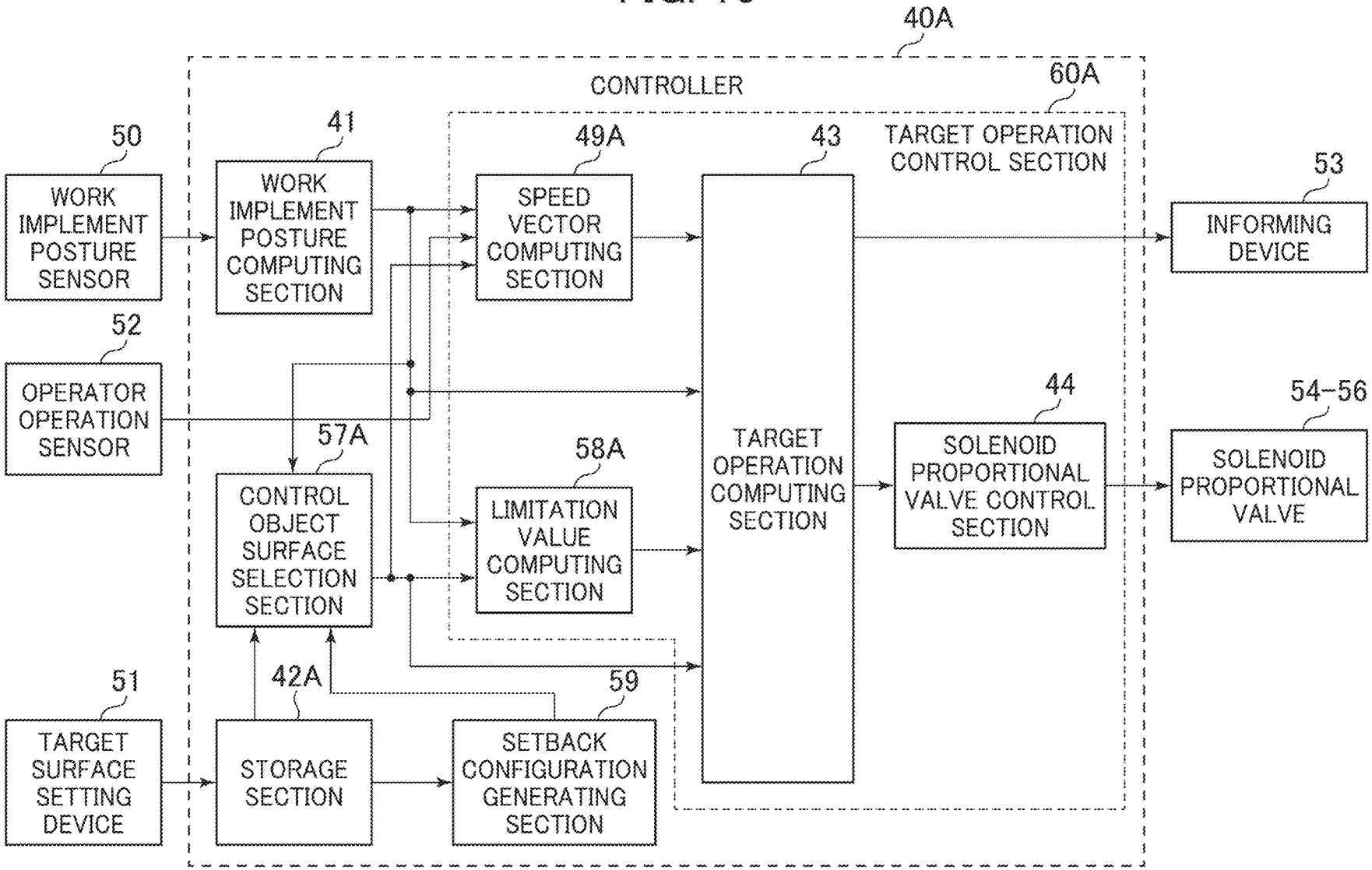
FIG. 10 is a functional block diagram illustrating a controller according to a second embodiment.

FIG. 10 is a functional block diagram illustrating a controller 40A according to an embodiment of the present invention. The controller 40A is equipped with a setback configuration generating section 59 as a function different from that of the first embodiment. Further, the functions of a storage section 42A, a control object surface selection section 57A, a speed vector computing section 49A, and a limitation value computing section 58A are different from those of the first embodiment. Regarding these, the description will center on the differences.

Figure 11:
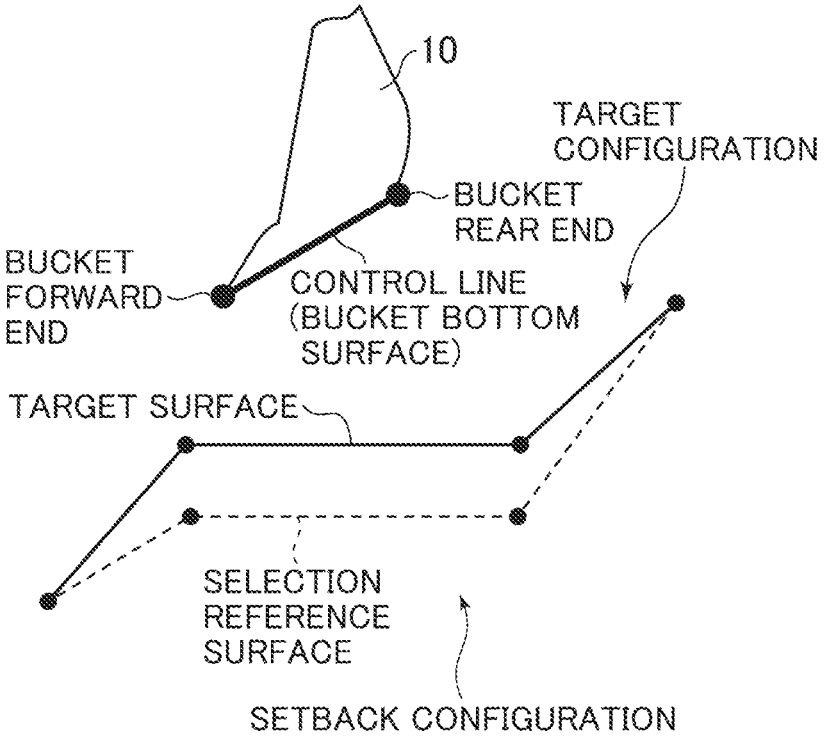
FIG. 11 is a conceptual drawing illustrating a setback configuration, a selection reference surface, a target configuration, and a target surface.

The storage section 42A stores the position on the excavator of the control line extracted from the contour of the sectional configuration of the forward end portion of the work implement 1A due to the operational plane. As shown in FIG. 11, in the present embodiment, there is used as the control line a segment connecting the forward end and the rear end of the bucket 10. Of the end portions in the front-rear direction of the planar portion of the bucket 10, the rear end of the bucket 10 is the end portion on the opposite side of the bucket forward end (claw end). In the following, the control line may be referred to as the "bucket bottom surface," and the control point determined on the bucket bottom surface may be referred to as the "bucket monitor point."

The setback configuration generating section 59 is a section which sets back a plurality of target surfaces constituting the target configuration related to the operational plane downwards by a predetermined amount, and which generates a configuration (setback configuration) obtained by connecting the plurality of surfaces after the setback (hereinafter referred to as the "selection reference surfaces"). The setback amount of the target surface when preparing the selection reference surfaces can be changed as appropriate in accordance with the degree of intrusion of the claw tip under the target surface when the area limiting control deteriorates in accuracy. For example, it can be set to approximately several centimeters. FIG. 11 is a conceptual drawing illustrating a setback configuration, a selection reference surface, a target configuration, and a target surface. In the example of FIG. 11, the left and right end points of the setback configuration coincide with the left and right end points of the target configuration, and there is no setback from the target configuration. This, however, should not be construed restrictively. Like the other points, the left and right end points of the setback configuration may be set back from the target configuration.

The setback configuration and the selection reference surface generated by the setback configuration generating section 59 are output to the control object surface selection section 57A, and are utilized when selecting the control object surface.

While setting a bucket monitor point on the bucket bottom surface in accordance with a predetermined rule based on the posture information input from the work implement posture computing section 41, the target configuration in the operational plane input from the storage section 42, the setback configuration input from the setback configuration generating section 59, etc., the control object surface selection section 57A selects one control object surface suitable for the area limiting control from among the plurality of target surfaces constituting the target configuration.

Figure 12:
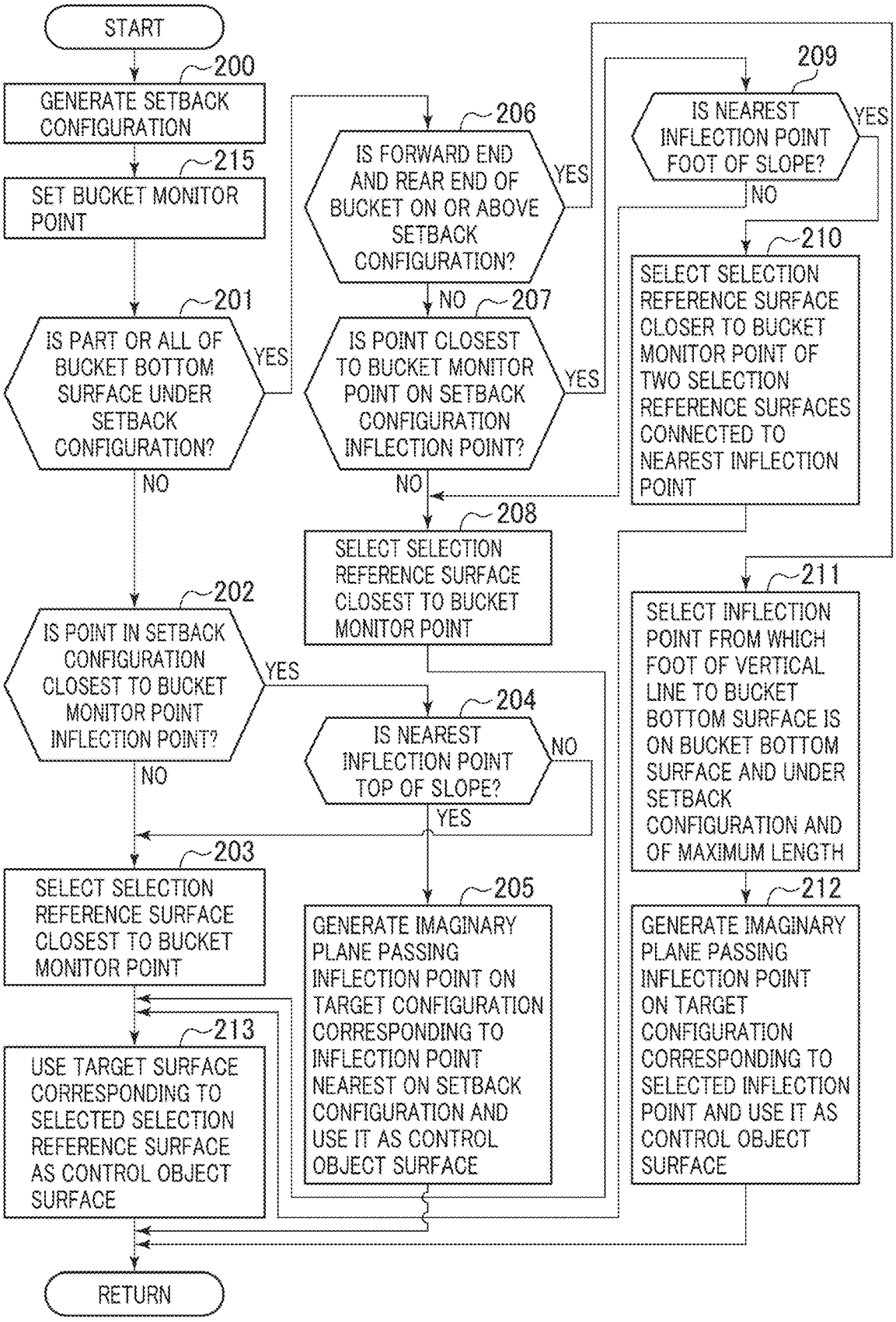
FIG. 12 is a flowchart according to which the controller according to the second embodiment selects the control object surface.

FIG. 12 is a flowchart according to which the control object surface selection section 57A according to the present embodiment selects the control object surface. In the case where the power source of the controller 40A is ON and where the limiting control switch 17 is ON (effective), the control object surface selection section 57A starts the processing of the flowchart of FIG. 12.

First, in step 200, the setback configuration generating section 59 generates a setback configuration regarding the operational plane at the point in time. It is also possible to previously generate the setback configuration and store it in the storage section 42A, constructing the controller 40A so as to take in the setback configuration from the storage section 42A in step 200.

In step 215, the control object surface selection section 57A sets the bucket monitor point on the bucket bottom surface in accordance with a predetermined rule based on the posture information input from the work implement posture computing section 41, the information on the target configuration and the control line in the operational plane input from the storage section 42, and the information on the setback configuration input from the setback configuration generating section 59. In the present embodiment, as the rule for determining the bucket monitor point from the bucket bottom surface, there is adopted the following rule: In the case where the bucket bottom surface is above the setback configuration or in the case where it is under the setback configuration, the point closest to the setback configuration on the bucket bottom surface is used as the bucket monitor point, and in the case where the bucket bottom surface crosses the setback configuration, the point intruding furthermost the setback configuration on the bucket bottom surface is used as the bucket monitor point. There are, however, no restrictions to the rule. For example, the bucket monitor point may be arbitrarily selected by the operator from the bucket bottom surface.

In step 201, the control object surface selection section 57A determines whether or not a part or entirety of the bucket bottom surface (control line) is under the setback configuration. Here, in the case where a part or entirety of the bucket bottom surface is not under the setback configuration, the procedure advances to step 202.

In step 202, it is determined whether or not the point closest to the bucket monitor point on the setback configuration is an inflection point (that is, an end point of any of the selection reference surfaces). Here, in the case where the point closest to the bucket monitor point on the setback configuration is not an inflection point but a point other than an end point of any of the selection reference surfaces (that is, in the case where the determination in step 202 is "NO"), the procedure advances to step 203.

In step 203, the selection reference surface closest to the bucket monitor point on the setback configuration is selected, and the procedure advances to step 213.

In step 213, the control object surface selection section 57A selects the target surface corresponding to the selection reference surface selected in the processing immediately before (step 203, 208, or 210) as the control object surface.

In the case where it is determined in step 202 that the point closest to the bucket monitor point on the setback configuration is an inflection point (that is, in the case where the determination of step 202 is "YES"), it is determined in step 204 whether or not the inflection point is a top of slope. In the case where the inflection point is not a top of slope, the procedure advances to step 203. In the case where it is a top of slope, the procedure advances to step 205.

Figure 13:
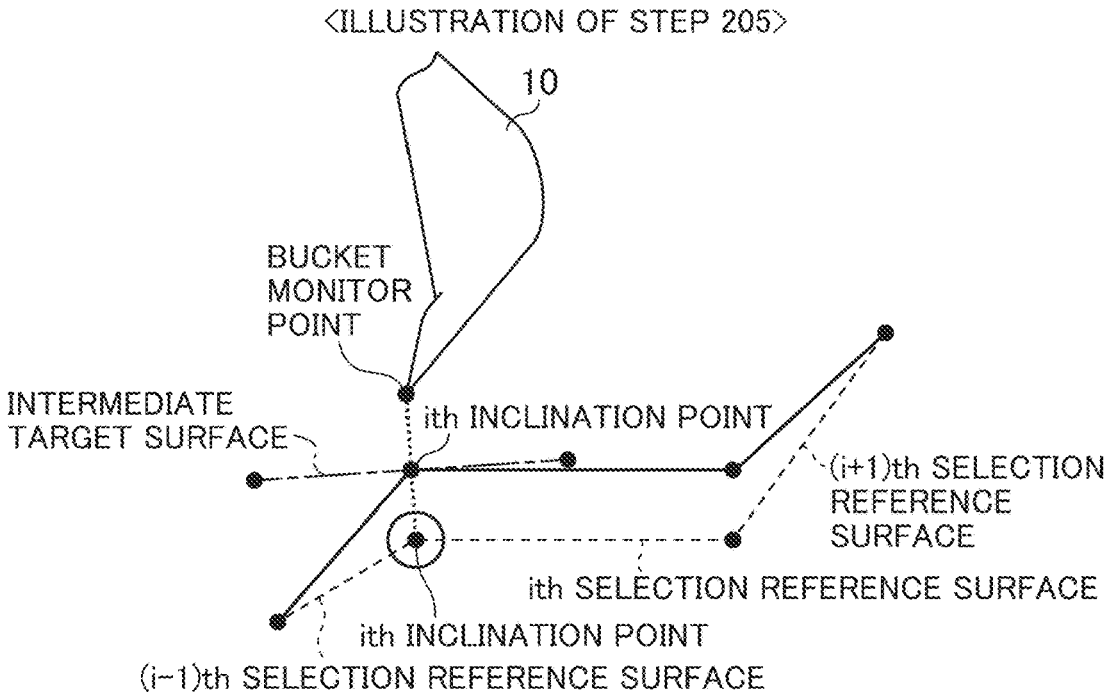
FIG. 13 is an explanatory view illustrating step 205 of the flowchart of FIG. 12.

FIG. 13 illustrates the situation of step 205. The bucket monitor point is the claw tip of the bucket 10. At this time, the point closet to the bucket monitor point on the setback configuration is the ith inflection point, so that it is not determined whether the selection reference surface closest to the bucket monitor point is whether the (i−1)th selection reference surface or the ith selection reference surface. In view of this, an imaginary plane passing the inflection point (the ith inflection point) on the target configuration corresponding to the ith inflection point on the setback configuration is used as the control object surface. In the present embodiment, the imaginary plane is referred to as the "intermediate target plane."

The reason for introducing the concept of intermediate target plane in the present embodiment is as follows: Around the top of slope, it frequently occurs that the control object surface is abruptly switched due to a slight difference in the positional relationship between the bucket monitor point and the target configuration. An abrupt switching of the target control plane may greatly affect the control performance. When, however, as in the present embodiment, the intermediate target plane is set, the abrupt switching of the control object surface is suppressed, so that it is possible to stabilize the control performance.

It is desirable for the preparation procedures for the intermediate target plane to be previously determined. It is desirable for the angle of the intermediate target plane to be set within the range of the angles of the two target surfaces connected to the inflection point (the ith inflection point). For example, a plane at a predetermined angle with respect to the bucket bottom surface at that time (for example, a plane parallel to the bucket bottom surface) is used as the intermediate target plane, or the inclination angle of the intermediate target plane is previously determined, or a plane having an inclination angle equal to the angle with respect to the two target surfaces connected to the inflection point through which the intermediate target plane passes is used as the intermediate target plane.

In the case where it is determined in step 201 that a part or entirety of the bucket bottom surface is under the setback configuration, the procedure advances to step 206.

In step 206, it is determined whether or not the bucket forward end and rear end are on the setback configuration or in the region above the same. In the case where the bucket forward end and rear end are not on the setback configuration or in the region above the same, the procedure advances to step 207.

In step 207, it is determined whether or not the point closest to the bucket monitor point on the setback configuration is an inflection point. In the case where the point closest to the bucket monitor point is not an inflection point but a point other than an end point of any of the selection reference surfaces (that is, in the case where the determination result is "NO"), the procedure advances to step 208.

In step 208, the selection reference surface closest to the bucket monitor point on the setback configuration is selected, and the selection reference surface is used as the control object surface in step 213.

On the other hand, in the case where it is determined in step 207 the point closest to the bucket monitor point on the setback configuration is an inflection point (that is, in the case where the determination result is "YES"), the procedure advances to step 209, and it is determined whether or not the inflection point closest to the bucket monitor point on the setback configuration is a foot of slope. In the case where the inflection point is a foot of slope, the procedure advances to step 210.

Figure 14:
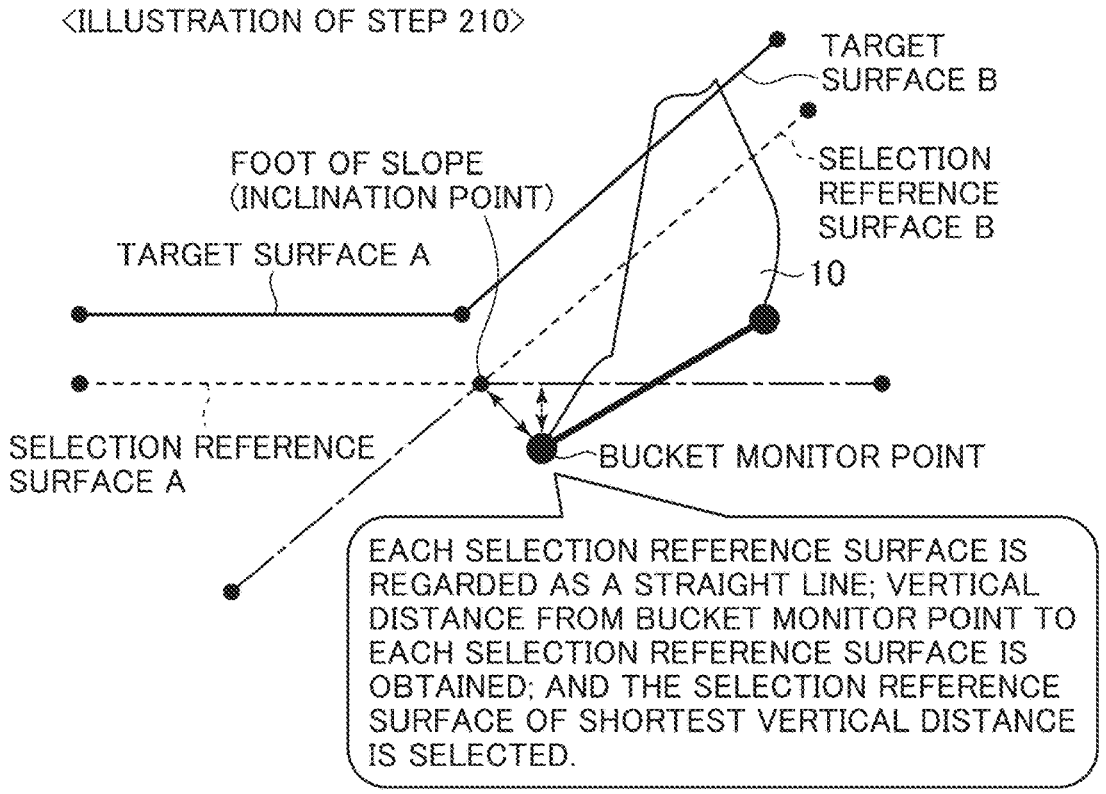
FIG. 14 is an explanatory view illustrating step 210 of the flowchart of FIG. 12.

In step 210, of the two selection reference surfaces connected to the inflection point that is a foot of slope, there is selected the selection reference surface closer to the bucket monitor point. More specifically, as shown in FIG. 14, the two selection reference surfaces A and B connected to the foot of slope (inflection point) are regarded as straight lines, and the vertical distance from the bucket monitor point to each of the selection reference surfaces A and B is calculated. The selection reference surface the vertical distance of which is smaller is selected. Thus, in the case of FIG. 14, the selection reference surface A is selected. In the case where the distances from the two selection reference surfaces A and B to the bucket monitor point are the same, the selection reference surface closer to the machine body is selected. The selection reference surface selected in step 210 serves as the control object surface in step 213.

In the case where it is determined in step 206 that the forward end and rear end of the bucket are on the setback configuration or in the region above the same, the procedure advances to step 211.

Figure 15:
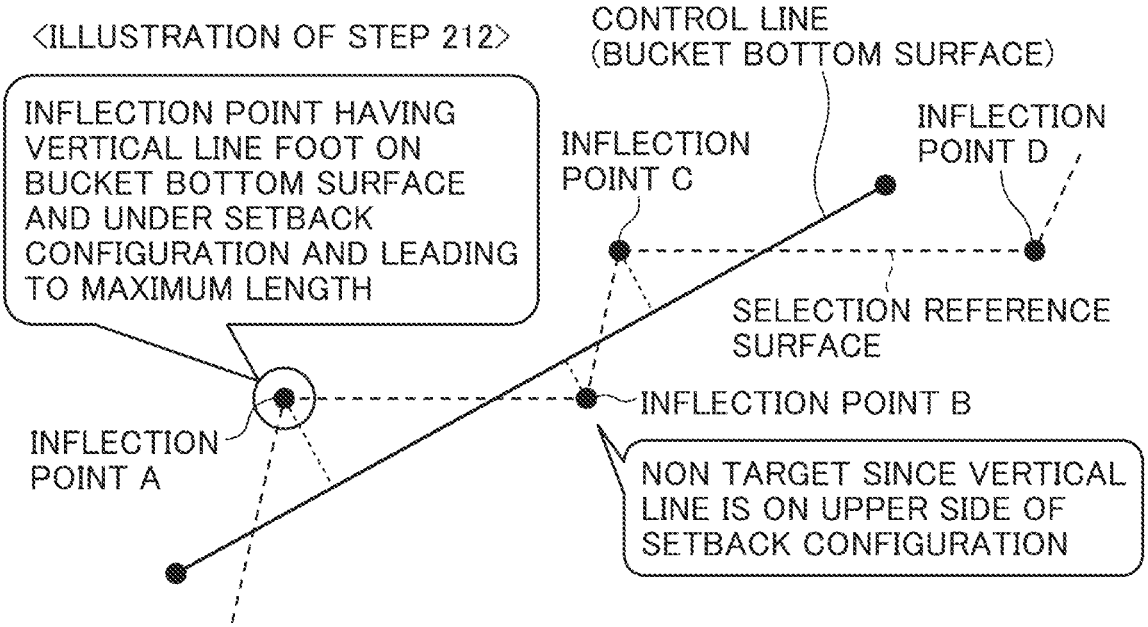
FIG. 15 is an explanatory view illustrating step 212 of the flowchart of FIG. 12.

The situation of step 211 is as follows: The forward end and rear end of the bucket are on the setback configuration or in the region above the same, and a part of the bucket bottom surface is under the setback configuration (that is, the bucket bottom surface crosses the setback configuration). At this time, in step 211, of the plurality of inflection points constituting the setback configuration, there is selected the inflection point the foot of the vertical line of which extended to the bucket bottom surface (control line) is situated on the bucket bottom surface, the vertical line of which is situated under the setback configuration, and the length of the vertical line of which is maximum. For example, in the example of FIG. 15, the feet of the vertical lines extended to the bucket bottom surface from the three inflection points A, B, and C are situated on the bucket bottom surface. The inflection point B, however, is out of the question since its vertical line is above the setback configuration. Of the remaining two inflection points A and C, the inflection point A, the length of the vertical line of which is maximum, is selected.

Next, in step 212, there is generated an intermediate target plane passing the inflection point on the target configuration corresponding to the inflection point on the setback configuration selected in step 211, and the intermediate target plane is used as the control object plane. As a result, the abrupt switching of the control object plane near the top of slope is suppressed, so that it is possible to stabilize the control performance.

Figure 16:
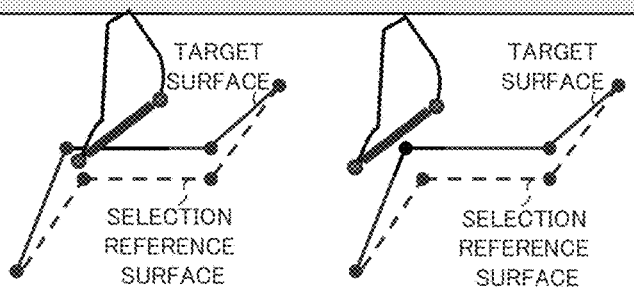
FIG. 16 is a diagram illustrating an example of the positional relationship between the bucket bottom surface, the target configuration, and the setback configuration in accordance with the determination results in steps 201 and 206.
Figure 16:
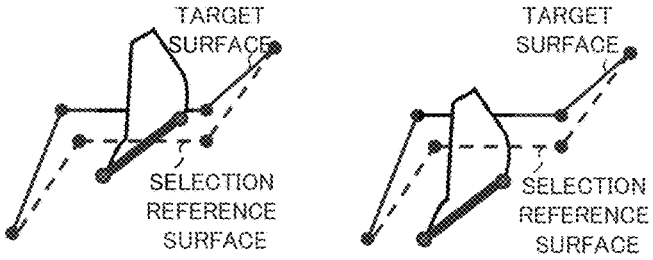
Figure 16:
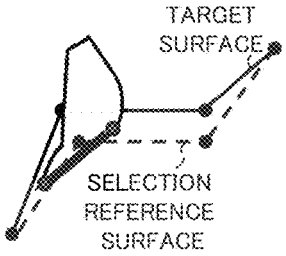

To facilitate the understanding of the flowchart of FIG. 12, FIG. 16 shows some examples of the positional relationship between the bucket bottom surface, the target configuration, and the setback configuration in accordance with the determination results in steps 201 and 206.

The speed vector computing section 49A computes the speed vector of the bucket monitor point due to operator operation. The limitation value computing section 58A calculates the limitation value 'a' of the vertical component of the speed vector of the bucket monitor point based on the distance D from the bucket monitor point to the control object surface. Regarding the function of the target operation computing section 43 and the solenoid proportional valve control section 44, it is the same as that in the first embodiment, so a description thereof will be left out.

Due to the above structure, also when a point in the segment connecting the forward end and rear end of the bucket (bucket bottom surface) is used as the control object, it is possible to select the proper target surface as the control object.

In the case where the bucket monitor point (control point) is changed based on the positional relationship between the bucket bottom surface (control line) and the target configuration, the processing of selecting the control object surface is likely to be complicated. When, however, the control object surface is set based on the positional relationship between the setback configuration and the bucket bottom surface as in the present embodiment, even in the case where the bucket claw tip intrudes slightly under the target configuration due to a control error or the like (more specifically, in the case where the procedure is to advance to step 202, that is, in the case where the bucket bottom surface crosses the target configuration but does not cross the setback configuration), it is possible to set the control object surface through substantially the same control as when the bucket bottom surface is on the target configuration, so that it is possible to simplify the control object surface selection processing.

Further, if the bucket to is allowed to intrude until the bucket bottom surface crosses the setback configuration or until it is situated under the setback configuration, it is possible to select the proper control surface in accordance with the intrusion position. More specifically, in the case where the intrusion occurs in the vicinity of a top of slope, the control surface can be set properly by the processing of step 212. In the case where the intrusion occurs in the vicinity of a foot of slope, the control surface can be set properly by the processing of step 210. In the case where the intrusion occurs in some other place, the control surface can be set properly by the processing of step 208.

The present invention is not restricted to the above-described embodiments but includes various modifications without departing from the scope of the gist of the invention. For example, the present invention is not restricted to a structure equipped with all the components described in connection with the above embodiments but also includes a structure in which the above components are partially deleted. Further, a part of the structure of a certain embodiment may be added to or replaced by the structure of another embodiment.

For example, in the case where the inflection point closest to the bucket claw tip is a top of slope, instead of the processing of step 103 of the first embodiment, an imaginary plane passing the inflection point (the above-mentioned intermediate target plane) may be prepared, and processing in which the imaginary plane is used as the control object surface may be executed.

Further, each structure, the function of each structure, the execution processing, thereof, etc. related to the controller 40, 40A may be realized partially or totally in hardware (for example, the logic for executing each function may be designed as an integrated circuit). Further, the structure related to the controller 40, 40A may consist of a program (software) which is read/executed by a computation processing apparatus (e.g., CPU) to thereby realize each function related to the structure of the controller 40, 40A. Information related to the program can be store, for example, in a semiconductor memory (flash memory, SSD or the like), a magnetic storage device (hard disk drive or the like), or a recording medium (magnetic disk, optical disk or the like).

DESCRIPTION OF REFERENCE CHARACTERS

1A: Front work implement
8: Boom
9: Arm
10: Bucket
30: Boom angle sensor
31: Arm angle sensor
32: Bucket angle sensor
40, 40A: Controller
41: Work implement posture computing section
42, 42A: Storage section
43: Target operation computing section
44: Solenoid proportional valve control section
45: Operation device (boom, arm)
46: Operation device (bucket, swing)
47: Operation device (traveling)
49, 49A: Speed vector computing section
53: Informing device
54, 55, 56: Solenoid proportional valve
57, 57A: Control object surface selection section
58, 58A: Limitation value computing section
59: Setback configuration generating section
60, 60A: Target operation control section

The invention claimed is:

1. A work machine comprising:
a multi-joint type work implement;
a plurality of hydraulic actuators driving the work implement;
an operation device outputting an operation signal to the plurality of hydraulic actuators;
a storage section storing a target configuration defined by connecting a plurality of target surfaces;
a control object surface selection section that uses a target surface closest to a control point set at a forward end portion of the work implement on the target configuration as a control object surface; and
a target operation control section that when an excavation operation is input from an operator via the operation device, controls the plurality of hydraulic actuators such that operational range of the control point is limited to the control object surface and a region above the control object surface, wherein
the control object surface selection section is configured to
determine whether or not a point closest to the control point on the target configuration is an inflection point when the control point is on the target configuration or in the region above the target configuration, and
use as the control object surface an imaginary plane passing an inflection point on the target configuration corresponding to the inflection point when it is determined that a point closest to the control point is an inflection point and when the inflection point is a top of slope.

2. The work machine according to claim 1, further comprising a setback configuration generating section generating a setback configuration obtained by connecting a plurality of selection reference surfaces set back downwardly the plurality of target surfaces constituting the target configuration, wherein
the storage section stores a control line which is a segment extracted from contour of a forward end portion of the work implement and previously set and in which the control point is set, and
the control object surface selection section is configured to
when a part or entirety of the control line is situated under the setback configuration and when both ends of the control line are on the setback configuration or in a region above the setback configuration,
select from among a plurality of inflection points constituting the setback configuration an inflection point a foot of a vertical line extending from which to the control line is situated on the control line, the vertical line extending from which is under the setback configuration, and length of the vertical line extending from which is maximum, and
use as the control object surface an imaginary plane passing the inflection point on the target configuration corresponding to the selected inflection point.

3. The work machine according to claim 1, further comprising a setback configuration generating section generating a setback configuration obtained by connecting a plurality of selection reference surfaces set back downwardly the plurality of target surfaces constituting the target configuration, wherein the storage section stores a control line which is a segment extracted from contour of a forward end portion of the work implement and previously set and in which the control point is set, and the control object surface selection surface is configured to determine whether or not a point closest to the control point on the setback configuration is an inflection point when a part or entirety of the control line is under the setback configuration and when both ends of the control line are not on the setback configuration or in the region above the setback configuration, use as the control object surface a target surface corresponding to the selection reference surface of the two selection reference surfaces connected to the inflection point closer to the control point when it is determined in the determination that a point closest to the control point is an inflection point and when the inflection point is a foot of slope, and use as the control object surface a target surface corresponding to the selection reference surface closest to the control point on the setback configuration when it is determined in the determination that a point closest to the control point is an inflection point and when the inflection point is not a foot of slope, or when it is determined in the determination that a point closest to the control point is not an inflection point.

4. The work machine according to claim 1, further comprising a setback configuration generating section generating a setback configuration obtained by connecting a plurality of selection reference surfaces set back downwardly the plurality of target surfaces constituting the target configuration, wherein the storage section stores a control line which is a segment extracted from contour of a forward end portion of the work implement and previously set and in which the control point is set, and the control object surface selection section is configured to determine whether or not a point closet to the control point on the setback configuration is an inflection point when a part or entirety of the control line is not under the setback configuration, use as the control object plane an imaginary plane passing an inflection point on the target configuration corresponding to the inflection point when it is determined in the determination that a point closest to the control point is an inflection point and when the inflection point is a top of slope, and use as the control object surface a target surface corresponding to the selection reference surface closest to the control point on the setback configuration when it is determined in the determination that a point closest to the control point is an inflection point and when the inflection point is not a top of slope, or when it is determined in the determination that a point closest to the control point is not an inflection point.

* * * * *